US007694846B2

(12) United States Patent
Yuyama et al.

(10) Patent No.: US 7,694,846 B2
(45) Date of Patent: Apr. 13, 2010

(54) MEDICINE STORING AND DISPENSING APPARATUS

(75) Inventors: Shoji Yuyama, Osaka (JP); Katsunori Yoshina, Osaka (JP); Takafumi Imai, Osaka (JP); Masahito Miyashita, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 733 days.

(21) Appl. No.: 10/587,203

(22) PCT Filed: Jan. 19, 2005

(86) PCT No.: PCT/JP2005/000573

§ 371 (c)(1),
(2), (4) Date: Nov. 1, 2006

(87) PCT Pub. No.: WO2005/073088

PCT Pub. Date: Aug. 11, 2005

(65) Prior Publication Data

US 2007/0158357 A1 Jul. 12, 2007

(30) Foreign Application Priority Data

Jan. 30, 2004 (JP) ..... 2004-024660

(51) Int. Cl.
*B23Q 7/12* (2006.01)

(52) U.S. Cl. ..... 221/162; 221/168; 221/201; 221/203

(58) Field of Classification Search ..... 221/203, 221/162, 168, 201
See application file for complete search history.

(56) References Cited

U.S. PATENT DOCUMENTS

| | | | | | |
|---|---|---|---|---|---|
| 2,781,946 | A | * | 2/1957 | Wilcox et al. | 221/158 |
| 3,615,151 | A | * | 10/1971 | Sterling | 198/400 |
| 3,860,145 | A | * | 1/1975 | Miller | 221/159 |
| 5,208,762 | A | | 5/1993 | Charhut et al. | |
| 5,502,944 | A | * | 4/1996 | Kraft et al. | 53/55 |

FOREIGN PATENT DOCUMENTS

| | | |
|---|---|---|
| JP | 44-6877 | 3/1969 |
| JP | 48-7153 | 3/1973 |
| JP | 58-2116 | 1/1983 |
| JP | 7-251915 | 10/1995 |
| JP | 52-2679 | 1/1997 |
| JP | 2001-332893 | 11/2001 |
| JP | 2002-179004 | 6/2002 |

* cited by examiner

*Primary Examiner*—Gene Crawford
*Assistant Examiner*—Timothy R Waggoner
(74) *Attorney, Agent, or Firm*—Wenderoth, Lind & Ponack, L.L.P.

(57) ABSTRACT

A medicine storing and dispensing apparatus includes: a cap container (501) storing a plurality of caps (2) for closing openings of vial bottles (3) and having a plurality of slits (508) formed on the bottom surface thereof; a plurality of cap stirring members (502) protruding from a rotating shaft (509) and extending inside a cap container (501) through the slits (508); and a cap pathway (503) which continues to the cap container (501), has a clearance allowing only one cap (2) to pass through, and which is inclined downward so as to align the passing caps (2).

10 Claims, 23 Drawing Sheets

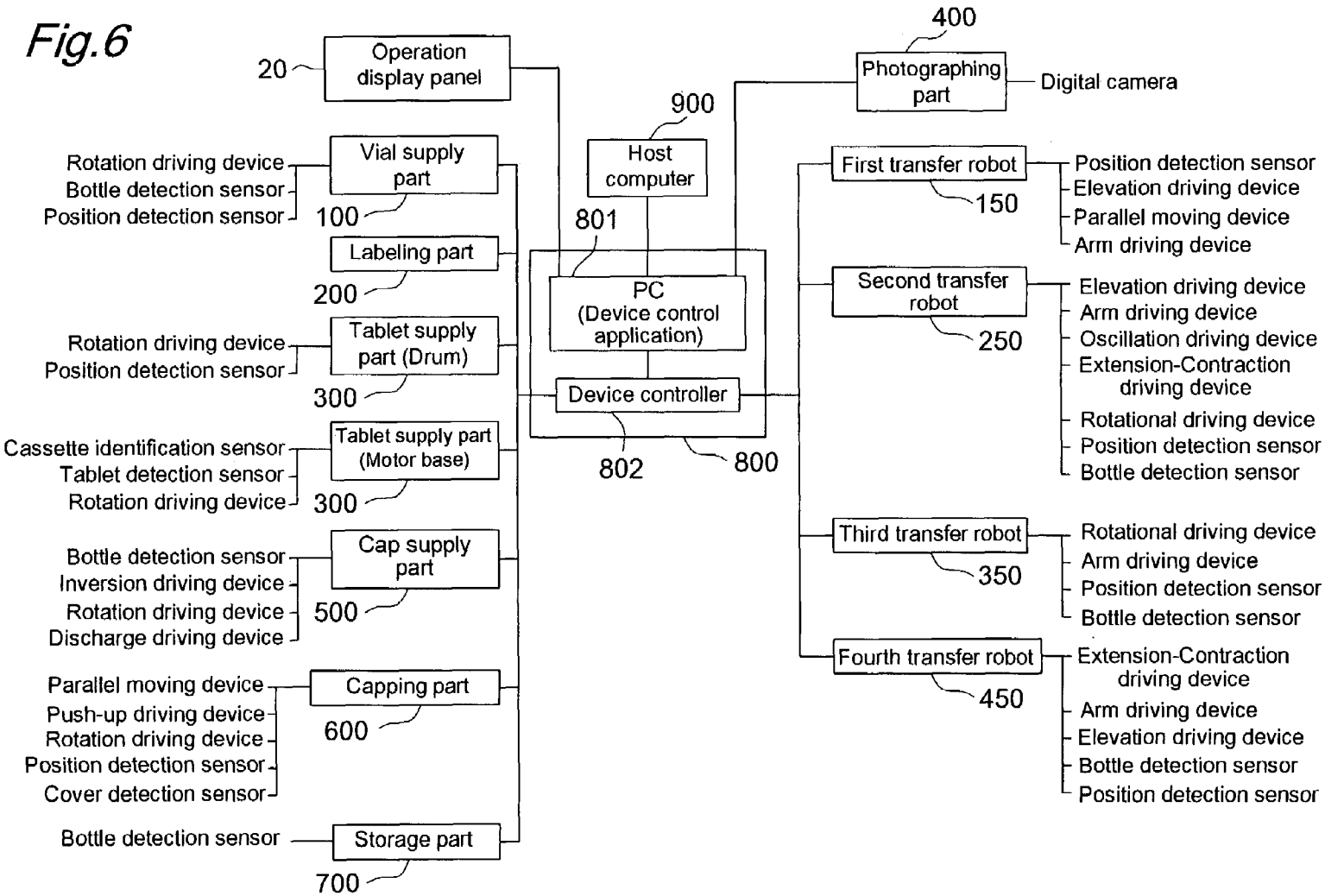
Fig.6
Photographing part
400
Digital camera
First transfer robot
150
Position detection sensor
Elevation driving device
Parallel moving device
Arm driving device
Second transfer robot
250
Elevation driving device
Arm driving device
Oscillation driving device
Extension-Contraction driving device
Rotational driving device
Position detection sensor
Bottle detection sensor
Third transfer robot
350
Rotational driving device
Arm driving device
Position detection sensor
Bottle detection sensor
Fourth transfer robot
450
Extension-Contraction driving device
Arm driving device
Elevation driving device
Bottle detection sensor
Position detection sensor
Host computer
900
PC (Device control application)
801
Device controller
802
800
Operation display panel
20
Vial supply part
100
Rotation driving device
Bottle detection sensor
Position detection sensor
Labeling part
200
Tablet supply part (Drum)
300
Rotation driving device
Position detection sensor
Tablet supply part (Motor base)
300
Cassette identification sensor
Tablet detection sensor
Rotation driving device
Cap supply part
500
Bottle detection sensor
Inversion driving device
Rotation driving device
Discharge driving device
Capping part
600
Parallel moving device
Push-up driving device
Rotation driving device
Position detection sensor
Cover detection sensor
Storage part
700
Bottle detection sensor

MEDICINE STORING AND DISPENSING APPARATUS

BACKGROUND OF THE INVENTION

1. Technical Field

The present invention relates to a medicine storing and dispensing apparatus having a function allowing automatic mounting of a cap on an upper opening of a vial bottle.

2. Description of the Related Art

Conventionally, vial bottles are closed by caps after medicine is stored therein (see, e.g., U.S. Pat. No. 5,502,944 and U.S. Pat. No. 5,208,762).

Apparatuses for feeding caps to containers include those structured to be able to feed caps one by one while applying vibration by a vibrator so that all the caps are orientated in the same direction and to change the direction of the caps by a posture control means so that the caps face the same direction (see, e.g., Japanese unexamined patent application No. H07-251915) and those structured to rotate a scraping disc plate provided aslant so as to utilize a stepped shape formed in an outer circumferential section of a center wheel (see, e.g., Japanese unexamined patent application No. 2002-179004).

SUMMARY OF THE INVENTION

However, in U.S. Pat. No. 5,502,944, the structure for automatically feeding caps to the vial bottles is not disclosed, while in U.S. Pat. No. 5,208,762, the particular structure therefor is not disclosed either. In the Japanese unexamined patent application no. H07-251915, the cap feeding section requires the vibrator and the posture control means, which causes problems such as high costs and complicated structure. Further, in the Japanese unexamined patent application no. 2002-179004, there is a problem in that a cap storable region is limited in order to accomplish appropriate direction change of the caps by the center wheel.

It is a primary object of the present invention to provide a medicine storing and dispensing apparatus that is capable of feeding caps all in the state of being oriented in the same direction to medicine containers by a simple and inexpensive structure.

As a means to solve the problem, there is provided, in the present invention, a medicine storing and dispensing apparatus comprising a cap feeding section. The cap feeding section includes:

a cap container storing a plurality of caps for closing openings of medicine containers and having a slit formed at least one location of a bottom surface of the cap container;

a cap stirring member which has at least one stirring section formed in a rotating shaft in the state of protruding inside the cap container through the slit and which stirs the caps by the stirring section through rotational driving; and a cap pathway which continues to the cap container, has a clearance allowing only one cap to pass through and which is inclined downward so as to align the passing caps.

With this structure, once the cap stirring member is driven, the caps in the cap container are stirred by the stirring section and go one by one in sequence into the cap pathway through the clearance so as to be aligned.

It is preferable that the cap container have an inclined surface that is inclined toward the rotating shaft of the cap stirring member. The inclined surface having each slit formed thereon, because it becomes easy to gather the stirred caps toward the clearance continuing to the cap pathway along the inclined surface.

It is preferable that the cap stirring member be structured so that the stirring section has a plurality of protruding sections placed on an outer circumferential section of the rotating shaft for allowing stirring of the caps toward the inclined surface through rotational driving, because it becomes possible to smoothly feed the caps to the cap pathway while preventing a cap jam in a vicinity of the clearance toward the cap pathway.

It is preferable that the cap stirring member be structured so that the stirring section has a plurality of protruding sections placed in a spiral manner on an outer circumferential section of the rotating shaft for allowing movement of the caps from one end side to the other end side of the rotating shaft through rotational driving and that the cap pathway be placed on the other end side of the rotating shaft, because each stirring member can guide the caps to the clearance toward the cap pathway only with rotational driving of the cap stirring member, which further allows smooth feeding of the caps to the cap pathway.

It is preferable that the cap stirring member be placed in a plurality of locations, because it becomes possible to further prevent a cap jam in the vicinity of the clearance toward the cap pathway and to smoothly move the caps to the cap pathway.

It is preferable that the cap pathway include:

an inclined support section for supporting incoming caps by engaging with inner recess sections of the moving caps so as to further incline the inner recess sections in a case where the passing caps are positioned with the inner recess sections thereof being oriented downward;

a cap detecting section for detecting the caps supported in an inclined state by the inclined support section;

an extruding means for moving the caps by canceling an engaged state of the caps supported by the inclined support section based on a detection result by the cap detecting section; and a cap direction changing section for changing a direction of the caps based on the detection result by the cap detecting section so as to orient the inner recess sections in an identical direction, because it becomes possible to align the inner recess sections of the caps in an identical direction with a simple and inexpensive structure.

It is preferable that the cap pathway have a pair of chute rails placed at an interval smaller than an inner diameter of the inner recess sections of the caps and that the inclined support section be formed by cutting away a part of the chute rails, because it becomes possible to credibly support the caps, which are positioned with their inner recess sections oriented downward, by the inclined support section while achieving smooth sliding movement of the caps in the cap pathway with a simple and inexpensive structure.

It is preferable that the cap pathway be composed of a first cap pathway positioned on an upstream side of the cap direction changing section and a second cap pathway positioned on a downstream side of the cap direction changing section and placed orthogonal to the first cap pathway, that the cap direction changing section include a guide pathway provided in a way of allowing rotational driving for storing the caps, which have moved through the first cap pathway, in an inclined state through a first opening on one end side and a guide plate for preventing the caps from dropping from a second opening on the other end side of the guide pathway, and that when the cap direction changing section is rotated so as to orient the second opening of the guide pathway obliquely downward, the guide plate be operated to connect the second opening and the second cap pathway for allowing movement of the caps, because the direction change for orienting all the inner recess sections of the caps in the same direction can be achieved by a simple and inexpensive structure.

It is to be noted that the medicine containers include all the containers capable of storing medicine such as medicine in vial bottles and having upper openings closed by caps, the containers being formed from various materials such as glass and synthetic resin.

Moreover, the caps include all the caps mounted on the upper openings of the medicine containers through pressing and/or rotation so as to be able to close the upper openings.

According to the present invention, simply stirring the caps stored in the cap container through driving of the cap stirring member enables the caps to be moved to the cap pathway through the clearance to be aligned, by which smooth feeding of the caps can be achieved regardless of the simple and inexpensive structure.

BRIEF DESCRIPTION OF THE DRAWINGS

FIG. 6 is a block diagram showing control by a control section;

REFERENCE NUMERALS

Figure 1:
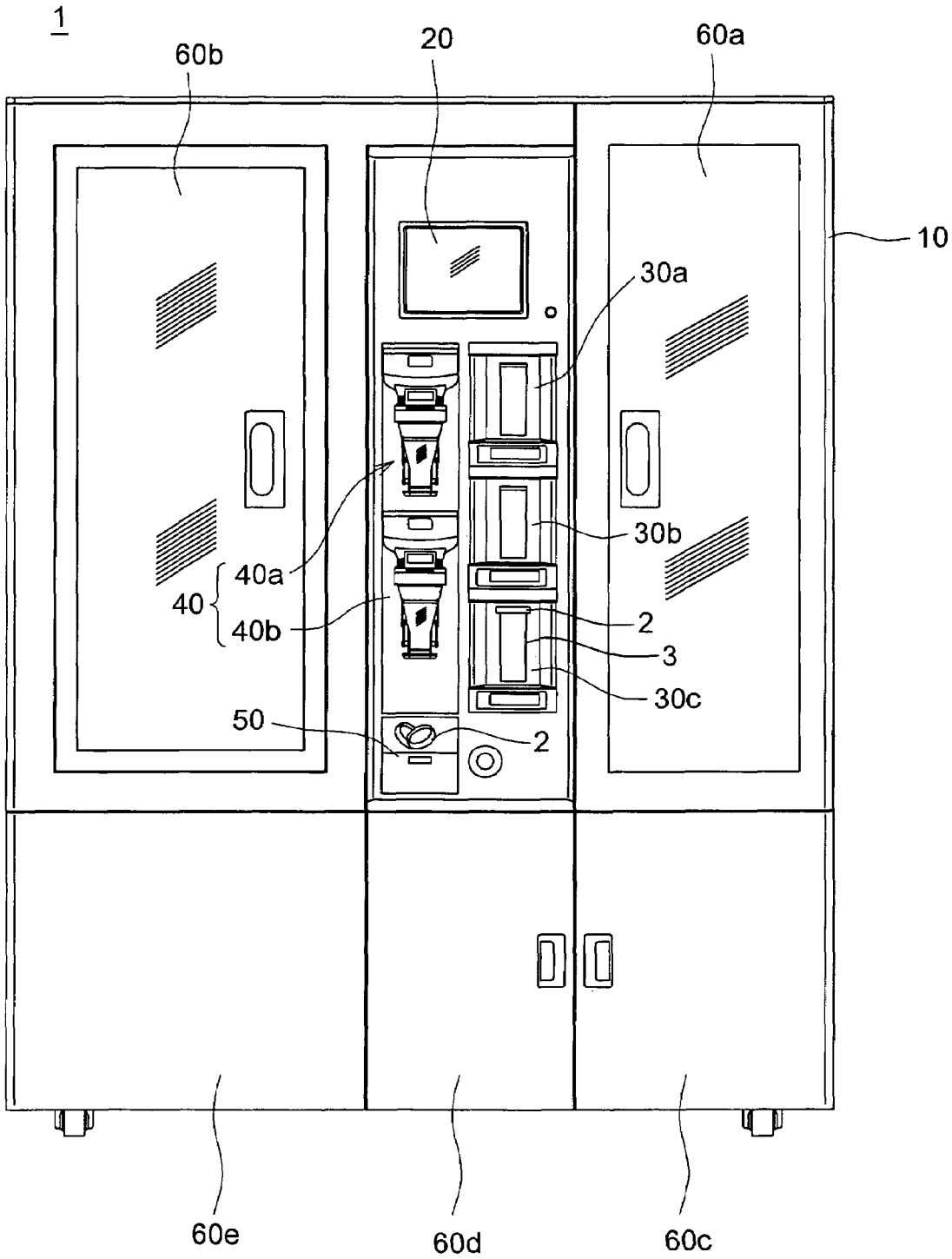
FIG. 1 is a front view showing a tablet storing and dispensing apparatus according to the present invention.

1 tablet storing and dispensing apparatus
2 cap
2*a* inner recess section
3 vial bottle
10 main body
20 operation display panel
30*a* output port
30*b* output port
30*c* output port
40 auxiliary tablet feeding section
50 auxiliary cap storing section
60*a*, 60*b*, 60*c*, 60*d*, 60*e* door
100 vial bottle feeding section
150 first transfer robot
200 labeling section
250 second transfer robot
300 tablet feeding section
350 third transfer robot
400 image pickup section
450 fourth transfer robot
500 cap feeding section
501 cap container
502*a*, 502*b* cap stirring member
503 cap pathway
504 first inclined surface
505 second inclined surface
506 vertical surface
507 lower inclined surface
508 slit
509 rotating shaft
510 stirring section
511*a*, 511*b* driven gear
512 motor
512*a* drive gear
513 direction changing section
514 first cap pathway
515 second cap pathway
516 inclined section
517 third inclined surface
518 guide surface
519 gap section
520 alignment pathway
521 cap stopping section
521*a* motor
522 cap detecting section
523 stop recess section
524 chute rails
525 removed section
526 pusher
526*a* link
527 first cap sensor
528 extruding section
529 rotating plate
530 support
530*a* spindle
530*b* roller
531 cylindrical body
531*a* spindle
532 cutaway section
532*a* recess section
532*b* spring

532*c* shank
533 guide plate
534 guide pathway
535 cap standby section
536 actuator
536*a* rod
537 feeding tray
538 roller
539 mounting tray
539*a* inclined section
540 first rod
541 second rod
542 link
542*a* spindle
542*b* spring
542*c* protrusion
550 guide piece
550*a* inclined section
543 second cap sensor
600 capping section
601 retaining member
602 container lifting member
604 cap retaining section
604*a* actuator
604*b* motor
605 container retaining section
606 sliding member
607 pressing section
608 engagement piece
609 container retaining arm
609*a* spindle
610 container retaining rollers
611 lifting motor
612 pinion
613 rack
614 lifting tray
615 first sensor
616 second sensor
617 third sensor
700 saving section
800 control section
900 host computer

DETAILED DESCRIPTION OF THE INVENTION

Figure 2:
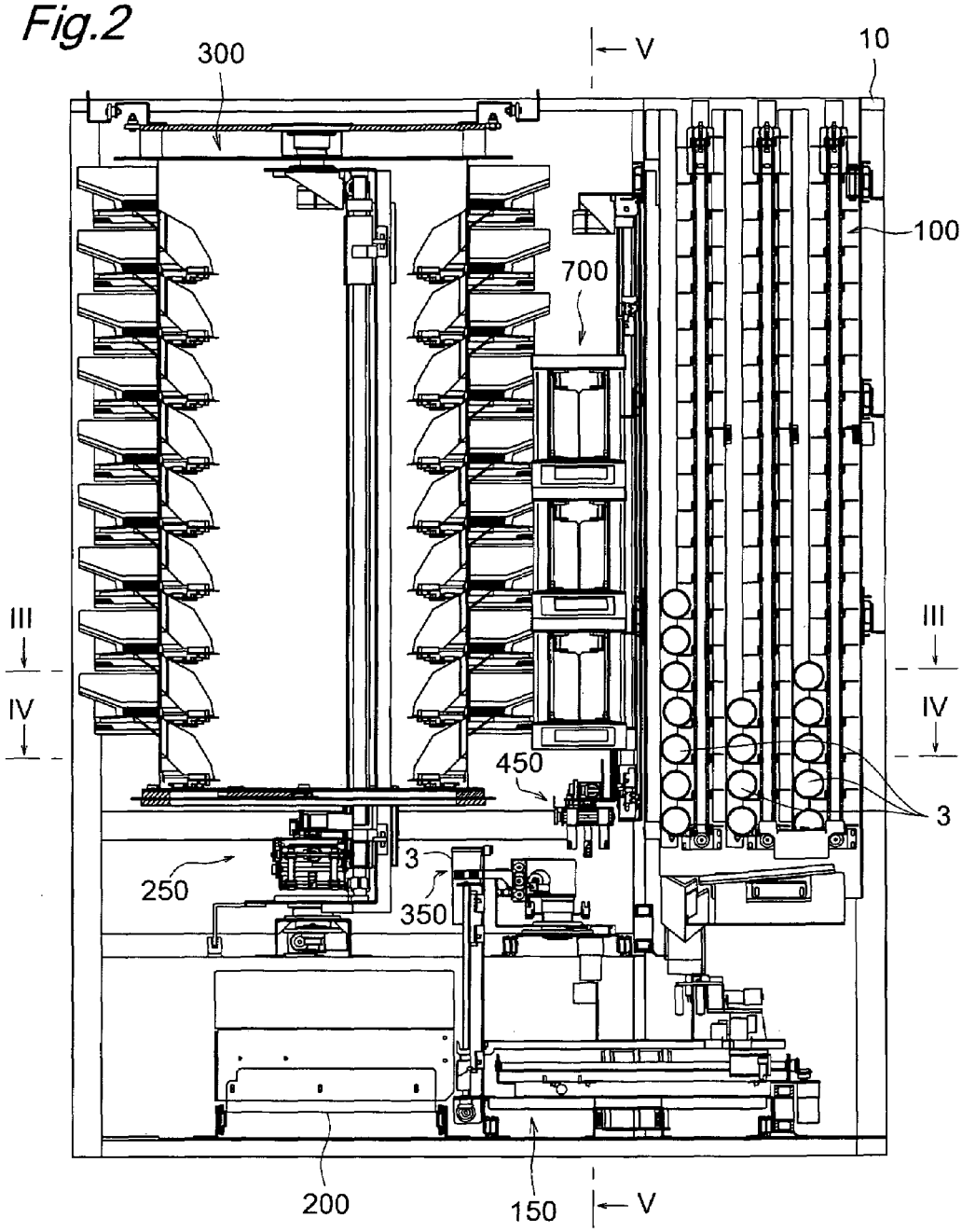
FIG. 2 is a front view showing the inside of the tablet storing and dispensing apparatus in FIG. 1.
Figure 3:
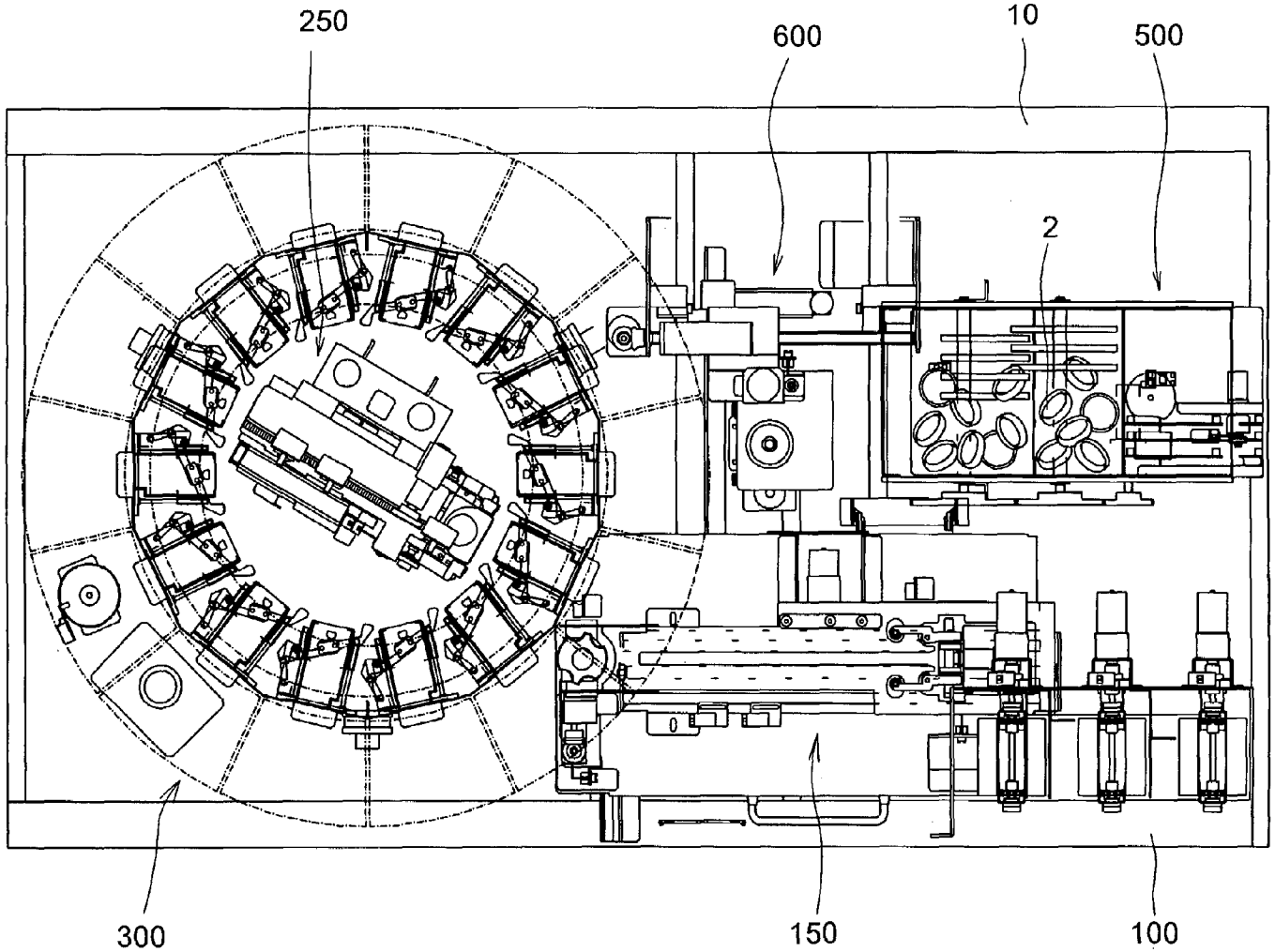
FIG. 3 is a cross sectional view taken along a line III-III in FIG. 2.
Figure 4:
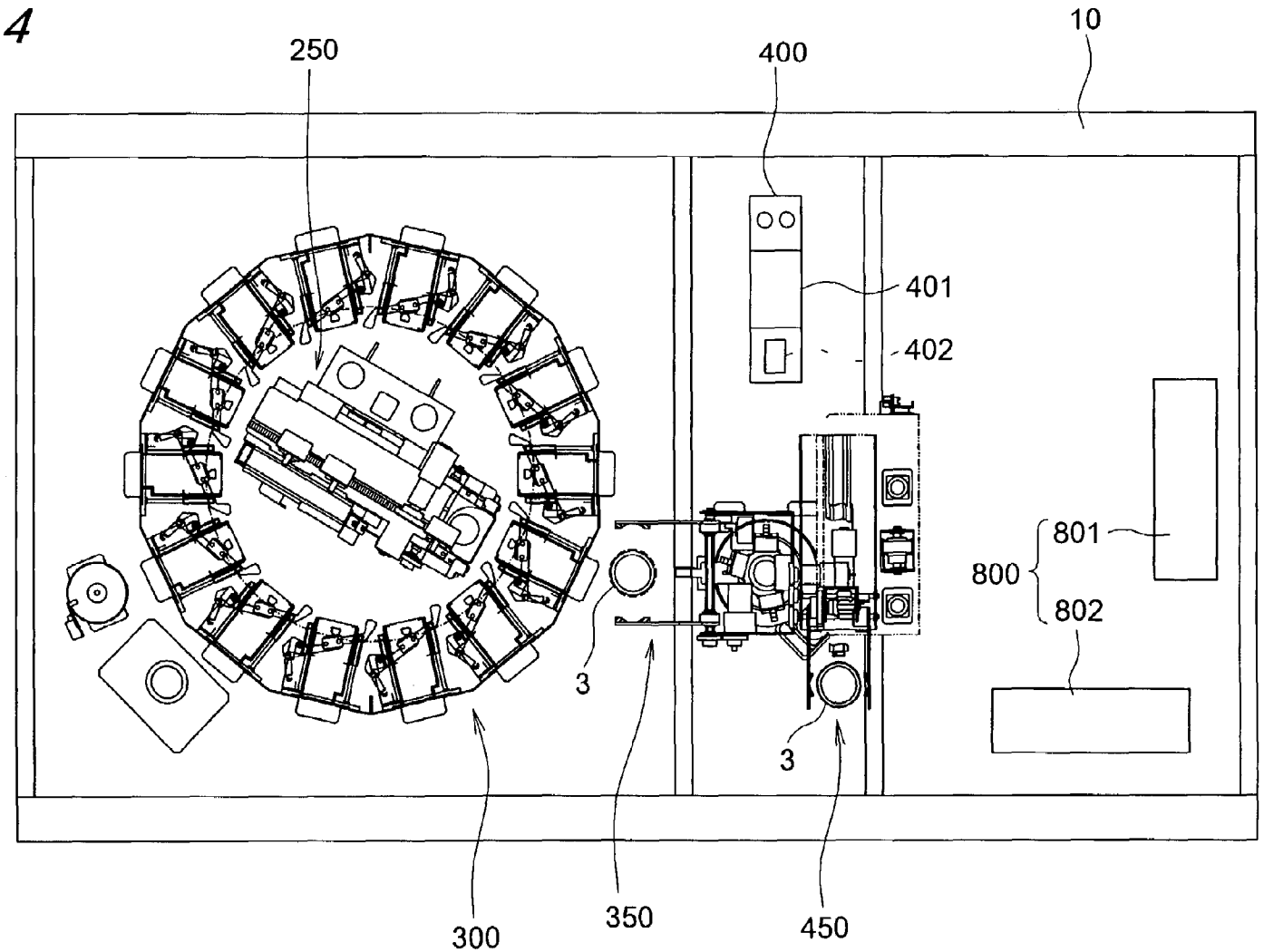
FIG. 4 is a cross sectional view taken along a line IV-IV in FIG. 2.
Figure 5:
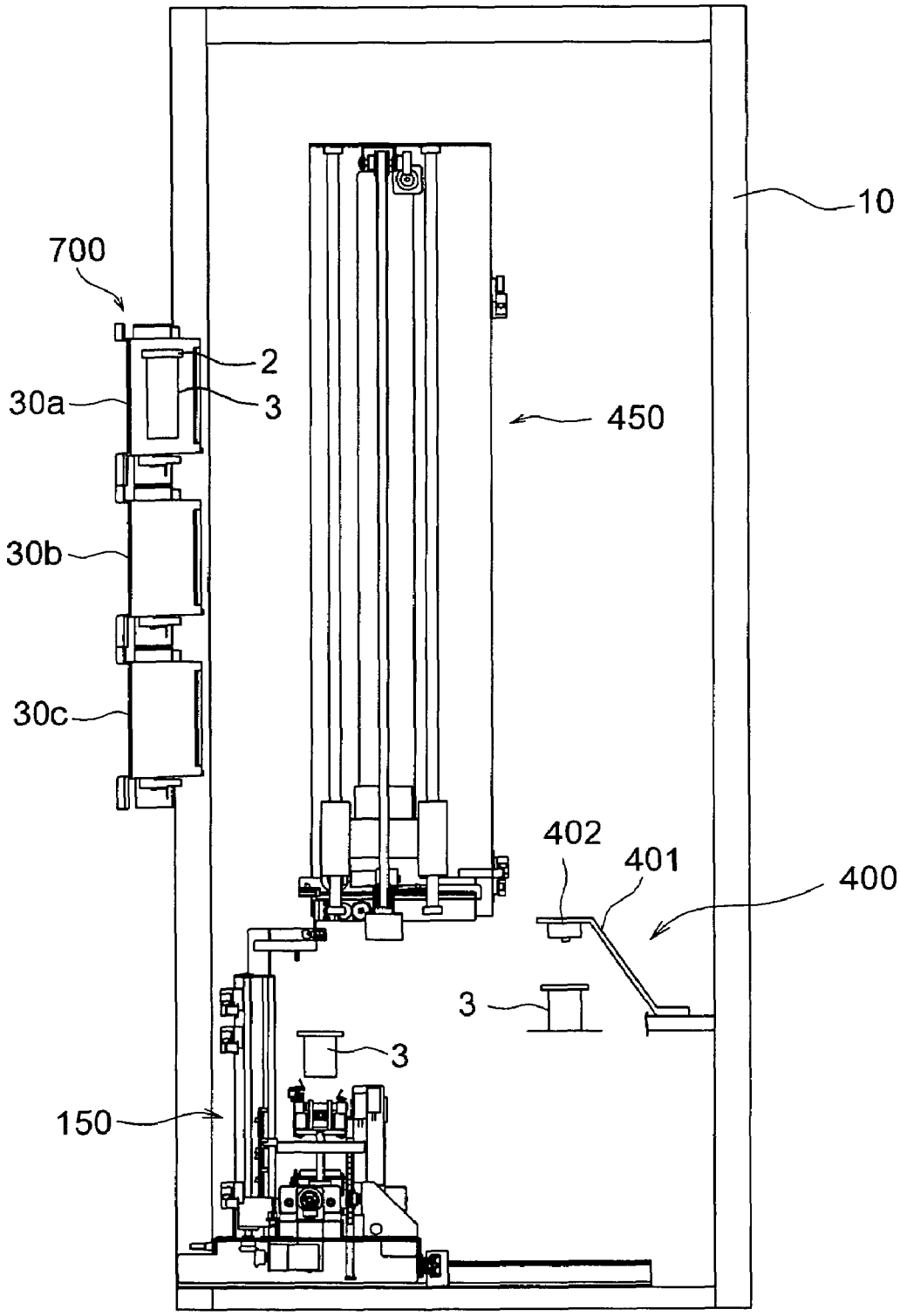
FIG. 5 is a cross sectional view taken along a line V-V in FIG. 2.

FIG. 1 is a front view showing a tablet storing and dispensing apparatus 1 according to the present invention, FIG. 2 is a front view showing the inside thereof, FIG. 3 is a cross sectional view taken along a line III-III in FIG. 2, FIG. 4 is a cross sectional view taken along a line IV-IV, and FIG. 5 is a cross sectional view taken along a line V-V.

1. Overall Layout

The overall layout of the tablet storing and dispensing apparatus 1 will now be described. As shown in FIG. 1, an operation display panel 20 for displaying information necessary for operation of the tablet storing and dispensing apparatus 1 is provided in an upper front central section of a main body 10. Three vial bottle output ports 30*a*, 30*b*, 30*c* are provided on the lower right side of the operation display panel 20, while an auxiliary tablet feeding section 40 (40*a*, 40*b*) is provided on the lower left side, and an auxiliary cap storing section 50 is provided below the auxiliary tablet feeding section 40 (40*a*, 40*b*). The auxiliary tablet feeding section 40 stores two kinds of pyrazolone medicine so as to feed the tablets based on prescription data. The auxiliary cap storing section 50 randomly stores a number of caps 2 so that the caps 2 can manually be taken out if necessary. A door 60*a* for supplementing vial bottles 3 is provided on the upper right side of the front of the tablet storing and dispensing apparatus 1, while a door 60*b* for replacing and supplementing tablets is provided on the left side, and doors 60*c*, 60*d*, 60*e* for maintenance are also provided on the lower side.

Inside the tablet storing and dispensing apparatus 1, there are provided, as shown in FIG. 2, FIG. 3 and FIG. 4, a vial bottle feeding section 100, a labeling section 200, a tablet feeding section 300, an image pickup section 400, a cap feeding section 500, a capping section 600 and a saving section 700. As shown in FIG. 2, the vial bottle feeding section 100 is provided on the right front side of the main body 10 for storing a number of vial bottles 3 by size and feeding the vial bottles 3 appropriate for housing the tablets according to the prescription data, one by one. The labeling section 200 is provided in the lower front center of the main body 10 for applying labels with prescription data printed thereon onto the vial bottles 3 fed from vial bottle feeding section 100. The tablet feeding section 300 is provided on the left side of the main body 10 for storing a number of tablets (non-pyrazolone) by kind and feeding the tablets according to the prescription data. As shown in FIG. 4, the image pickup section 400 is provided on the central rear surface side of the main body 10 for picking up images of the vial bottles 3 from the upper side so as to inspect the tablets contained in the vial bottles 3. As shown in FIG. 3, the cap feeding section 500 is provided on the right side of the main body 10 and in the rear of the vial bottle feeding section 100 for storing caps 2 for closing the vial bottles 3 and feeding the caps 2 one by one. The capping section 600 is provided on the central rear surface side of the main body 10 for plugging (closing) the vial bottles 3, which have been filled with the tablets, with the caps 2 fed from the cap feeding section 500. As shown in FIG. 5, the saving section 700 saves the vial bottles 3 filled with the tablets and plugged with the caps 2 to permit operators to take out the vial bottles 3 from the output ports 30*a*, 30*b*, 30*c*.

As shown in FIG. 2, the tablet storing and dispensing apparatus 1 is further equipped with a first transfer robot 150, a second transfer robot 250, a third transfer robot 350 and a fourth transfer robot 450. The first transfer robot 150, which is provided below the vial bottle feeding section 100, is capable of retaining the vial bottles 3 fed from the vial bottle feeding section 100, horizontally transferring the vial bottles 3 from the vial bottle feeding section 100 to the labeling section 200 in the leftward direction of the main body and transferring the vial bottles 3 upward from the labeling section 200 to the second transfer robot 250 or to the third transfer robot 350. The second transfer robot 250, which is provided inside the tablet feeding section 300, is capable of retaining the vial bottles 3 delivered from the first transfer robot 150, transferring the vial bottles 3 to each feeding port in the tablet feeding section 300, and transferring the vial bottles 3 from the feeding ports to the third transfer robot 350. The third transfer robot 350, which is provided above the first transfer robot 150 in the main body 10, is capable of delivering the vial bottles 3 delivered from the first transfer robot 150 or the second transfer robot 250 to the capping section 600 and the fourth transfer robot 450. The fourth transfer robot 450, which is provided above the third transfer robot 350, is capable of transferring the vial bottles 3 delivered from the third transfer robot 350 to the saving section 700 in the upward direction.

Moreover, as shown in FIG. 4, the tablet storing and dispensing apparatus 1 includes a control section 800 on the right side of the main case 10. As shown in the block diagram in FIG. 6, the control section 800 is composed of a personal computer (PC) 801 with a device control application installed thereinto and an equipment control device 802 made of a microcomputer and the like. The PC 801 is connected to a host computer 900 provided in hospitals and pharmacies for receiving inputs of data such as prescription data. The PC 801 is also connected to the operation display panel 20 for outputting display information necessary for operation of the tablet storing and dispensing apparatus 1 and receiving inputs of operation information from a touch panel on the operation display panel 20. The PC 801 is further connected to a digital camera in the image pickup section 400. The equipment control device 802 is connected to sensors and drive units of the vial bottle feeding section 100, the labeling section 200, the tablet feeding section 300, the cap feeding section 500, the capping section 600 and the saving section 700 for executing drive control of each section and is further connected to sensors and drive units of the first transfer robot 150, the second transfer robot 250, the third transfer robot 350 and the fourth transfer robot 450 for executing drive control of each section.

2. Structure of Cap Feeding Section 500

Figure 7:
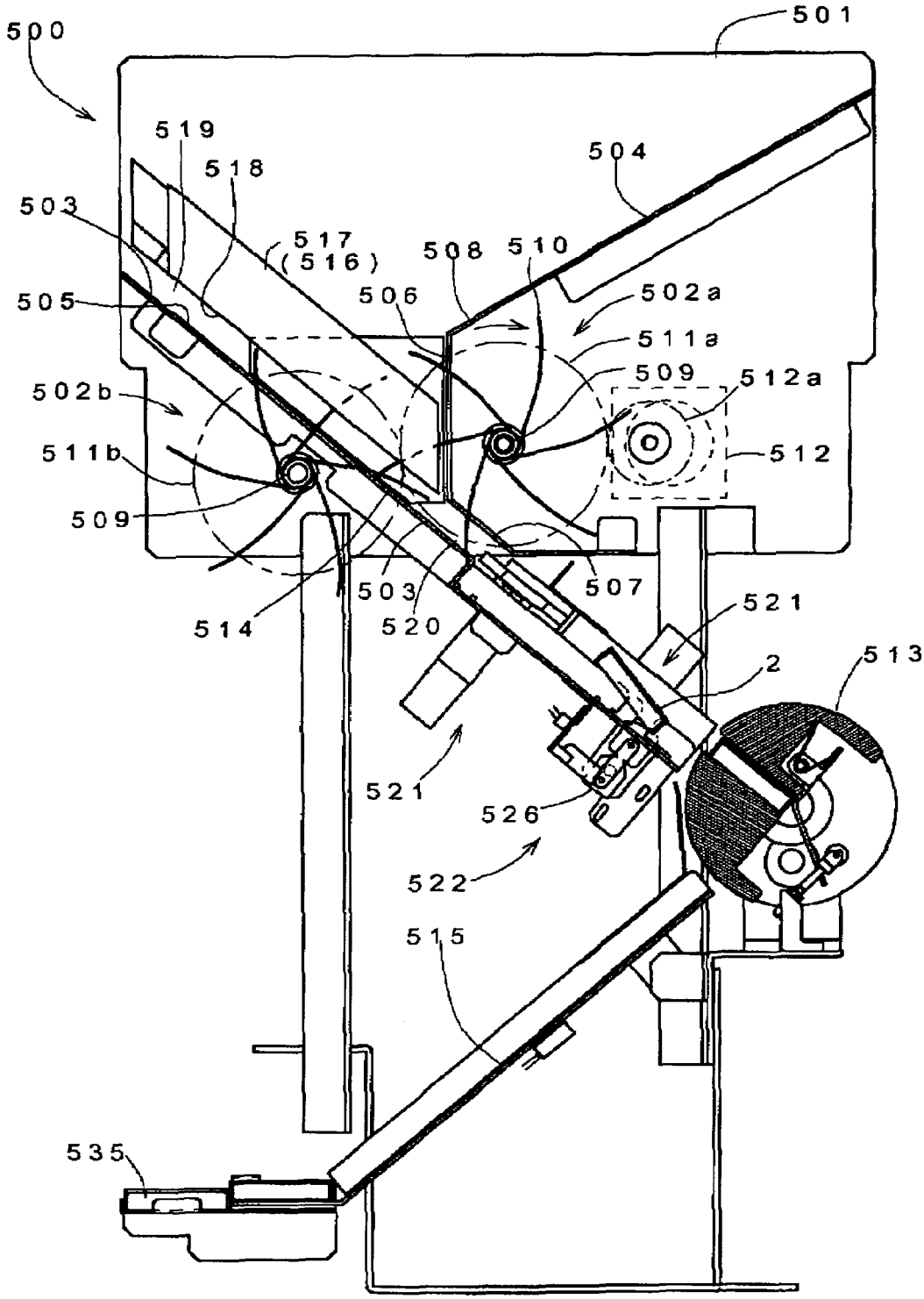
FIG. 7 is a front cross sectional view showing a cap feeding section.
Figure 8:
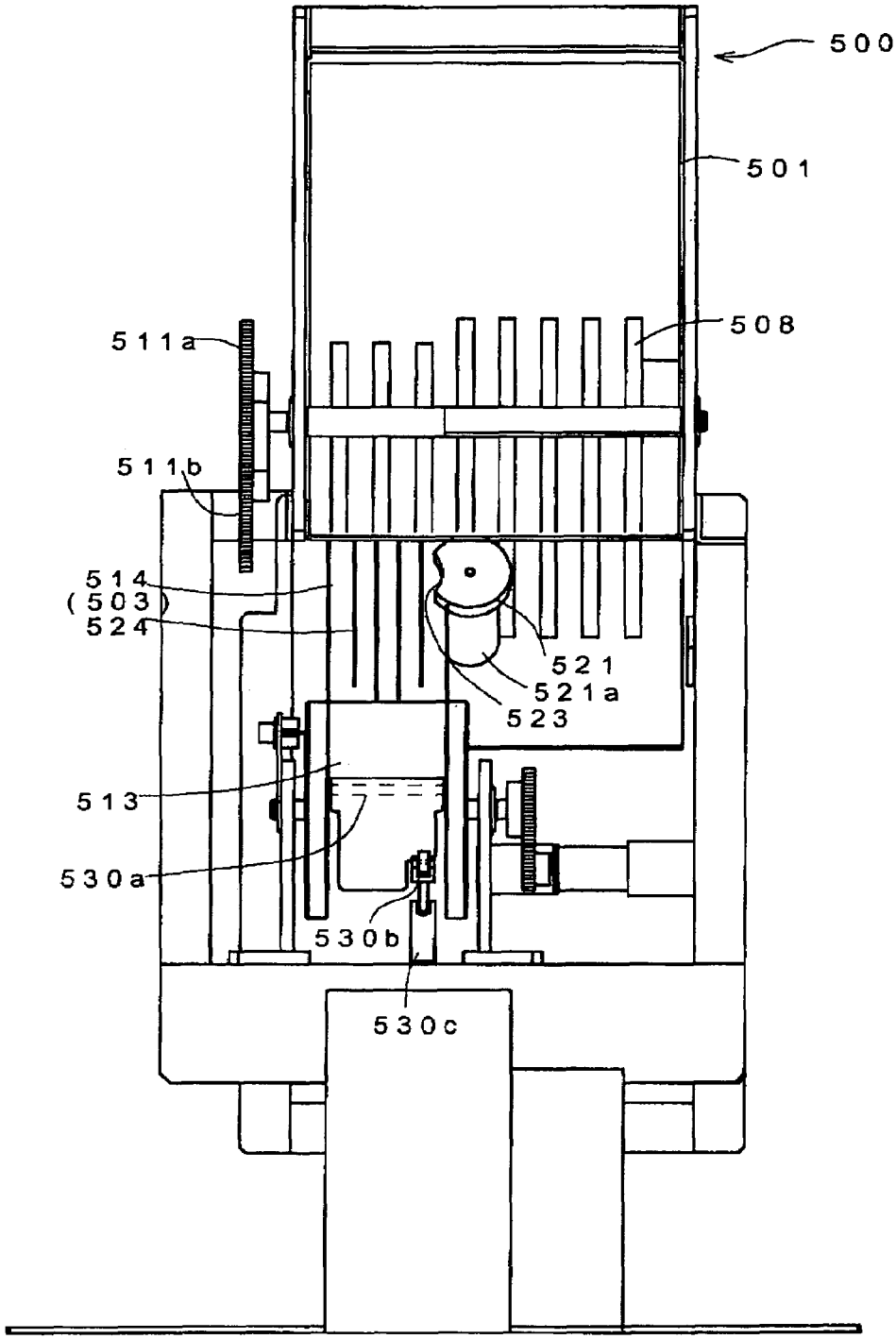
FIG. 8 is a side view showing the cap feeding section.
Figure 9:
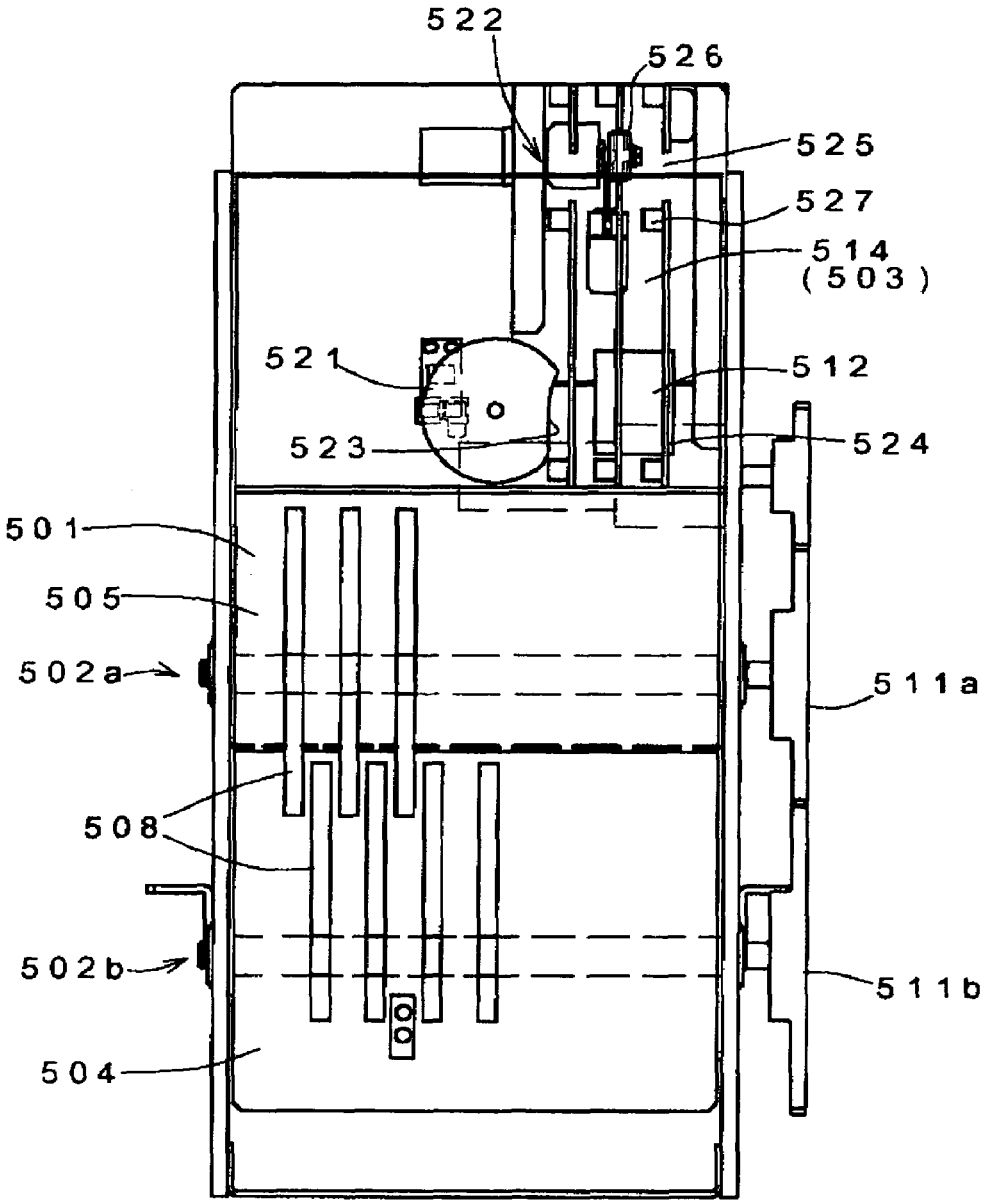
FIG. 9 is a plan view showing the cap feeding section.

As shown in FIG. 7 to FIG. 9, the cap feeding section 500 is composed of a cap container 501 for storing a plurality of the caps 2, cap stirring members (cap stirring devices) 502*a*, 502*b* for stirring the caps 2 inside the cap container 501, and a cap pathway 503 for the caps 2 in the cap container 501 to move. It is to be noted that the vial bottles 3 and the caps 2 used herein are provided with a locking mechanism in order to prevent the vial bottles 3 and the caps 2 from being easily uncapped by children. More specifically, an engagement section (not shown) protruding to the outer circumferential side is formed on the upper opening of the vial bottle 3. Moreover, an engagement receiving section (not shown) for engaging and disengaging the engagement section is formed on the cap 2, and an elastic protruding section (not shown) is mounted as an independent component on an inner recess section 2*a*. Consequently, once the cap 2 is mounted on the vial bottle 3, the cap 2 cannot be removed from the vial bottle 3 unless the cap 2 is pressed toward the vial bottle 3 against an elastic force of the elastic protruding section of the cap 2 before the cap 2 is rotated so as to release the engagement section from the engagement receiving section.

The cap container 501 is composed of two inclined surfaces (first inclined surface 504 and a second inclined surface 505) each having a bottom surface in a generally V shape in cross section. A vertical surface 506 and a lower inclined surface 507 continuing to the first inclined surface 504 as well as the second inclined surface 505 have slits 508 each formed at specified intervals in the width direction.

A cap stirring member 502 is formed by protruding a plurality of stirring sections 510 in the radial direction from a rotating shaft 509. Each of the stirring sections 510 is made of a wire rod, which is placed in a spiral manner around the rotating shaft 509 with its top end section being gradually curved toward the downstream side of the rotating direction. The cap stirring member 502 is placed at two locations so that the rotating shafts 509 are parallel to each other. In one cap stirring member 502*a*, the stirring sections 510 protrude into the cap container 501 through the respective slits 508 formed on the first inclined surface 504, while in the other cap stirring member 502*b*, the stirring sections 510 protrude through the slits 508 formed on the second inclined surface 505. The stirring sections 510 of the cap stirring members 502*a*, 502*b* are placed in the state of being axially displaced so as to overlap with each other. Driven gears 511*a*, 511*b* gearing with each other are respectively mounted on one end portions of the rotating shaft 509 of the cap stirring member 502*a*, 502*b*. The driven gears 511*a*, 511*b* gear with a drive gear 512*a* rotated by the driving of a motor 512, and both of the cap stirring members 502*a*, 502*b* rotate in synchronization with this rotation.

The cap pathway 503 is composed of a first cap pathway 514 and a second cap pathway 515 placed so as to be orthogonal to each other via a cap direction changing section (cap direction changing device) 513.

The first cap pathway 514 is composed of a space formed by an inclined section 516 extending from the inner side surface of the cap container 501 and the second inclined surface 505. The inclined section 516 is composed of a third inclined surface 517 which gradually comes closer to the second inclined surface 505 from the inner side surface while staying parallel to the second inclined surface 505 and a guide surface 518 parallel to the second inclined surface 505. Between the guide surface 518 and the second inclined surface 505, a clearance (gap section 519), which allows only one cap 2 to pass in the thickness direction, is formed. Consequently, when the cap stirring member 502 is driven to stir the caps 2 in the cap container 501, the caps 2 sequentially go into the first cap pathway 514 one by one through the gap section 519. Moreover, the caps 2 which have gone into the first cap pathway 514 are aligned in an alignment pathway 520 defined by the guide surface 518, the second inclined surface 505 and both inner side surfaces.

Along the first cap pathway 514, a cap stopping section 521 and a cap detecting section 522 are provided.

As shown in FIG. 8 and FIG. 9, the cap stopping section (cap stopping device) 521 is a disc having a stop recess section 523 formed by cutting off a part of the disc. The cap stopping section 521 can temporarily stop the caps 2 moving on the cap pathway 503 by their own weight, retain the caps 2 in the stop recess section 523 by rotating them by driving of a motor 521*a* and sequentially moving them downward one by one.

The cap detecting section 522 is composed of a pusher 526 and a first cap sensor 527 provided in a removed section 525 formed by removing a part of chute rails 524 formed on the bottom surface of the cap pathway 503 at a specified interval. The interval of the chute rails 524 is ⅔ of a maximum inner diameter of the inner recess section 2*a* of the cap 2. Consequently, the cap 2 sliding on the chute rails 524 has the inner recess section 2*a* facing down, as a result of which a part of the cap 2 falls in the removed section 525 and stops in the inclined state supported by upper notch ends and lower notch ends of the chute rails 524.

Figure 10:
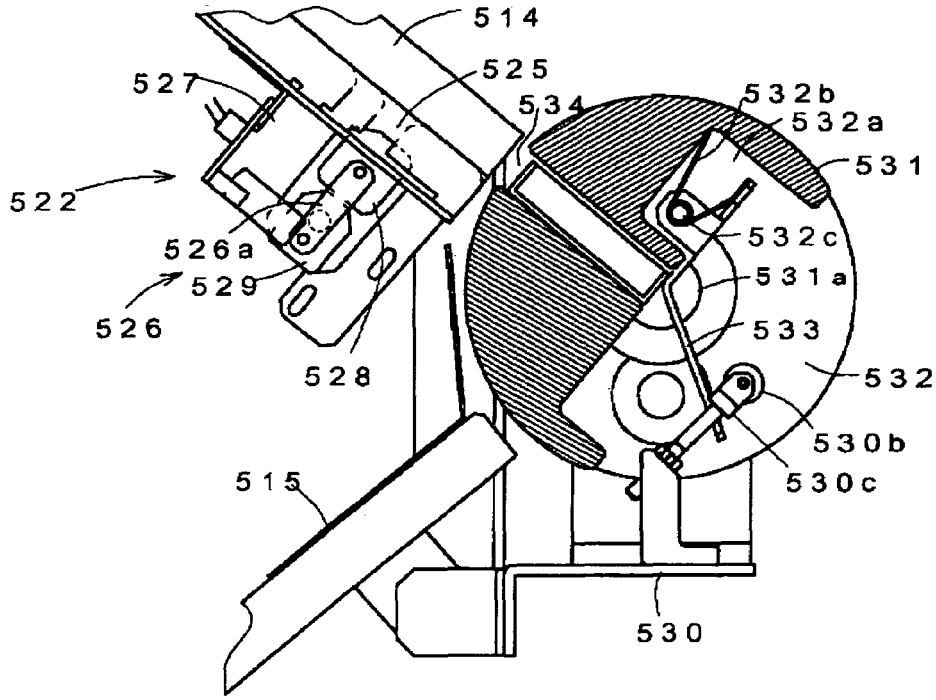
FIG. 10 is a fragmentary enlarged cross sectional view showing a cap direction changing section in FIG. 7.

As shown in FIG. 10, the pusher 526 is composed of an extruding section 528 to which an end portion of a link 526*a* is rotatably connected and a rotating plate 529 to which the other end portion of the link 526*a* is rotatably connected. When the rotating plate 529 is rotated by driving of a motor (not shown), the extruding section 528 reciprocates via the link 526*a*. By the extruding section 528 moving to a protruding position, a part of the cap 2 maintained in the inclined state by the upper notch ends and the lower notch ends of the chute rails 524 is pushed onward to be parallel to the first cap pathway 514 and thereby transferred to the cap direction changing section 513.

Moreover, the first cap sensor 527 detects the inclined state of the cap 2 supported by the removed section 525 of the chute rails 524, and a detection signal thereby is used for drive control of the pusher 526 and the later-described cap direction changing section 513.

As shown in FIG. 10, the cap direction changing section 513 is made of a cylindrical body 531 provided rotatably around a spindle 531*a* mounted on a support 530, the cylindrical body 531 having a cutaway section 532 with a semicircle cross section formed on an outer circumferential section of the cylindrical body 531, the cutaway section 532 having a guide plate 533 placed therein. The cylindrical body 531 has a guide pathway 534 formed from the outer circumferential surface to the cutaway section 532 so that the cap 2, which has passed the cap detecting section 522, can go into the cutaway section 532 (via a first opening 534*a*). Moreover, the cutaway section 532 has an escape recess section 532*a*, in which a spring 532*b* is placed. The spring 532*b* is made of a plate spring, which is mounted on a shank 532*c* provided in the escape recess section 532*a*, and one end section of the spring 532*b* is fixed onto the bottom surface of the escape recess section 532*a* while the other end section is fixed to one end section of the guide plate 533. As a result, the guide plate 533 is elastically supported by the spring 532*b* and is positioned so that a curved section closes one end side (second opening 534*b*) of the guide pathway 534 in order to prevent the caps 2 from dropping from the guide pathway 534. Moreover, the support 530 is provided with a contact section 530*c* having a rotatable roller 530*b* placed at the top end thereof. The contact section 530*c* comes into contact with one end section of the guide plate 533, thereby elastically deforming the spring 532*b* and positioning the guide plate 533 so as to connect the guide pathway 534 and the second cap pathway 515.

Figure 11:
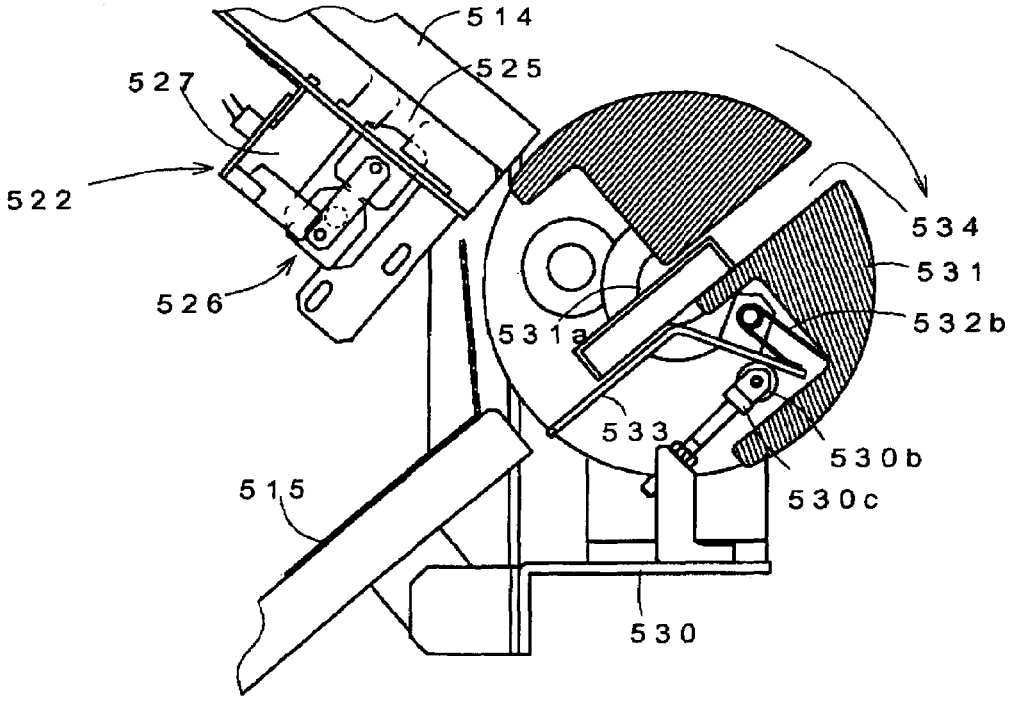
FIG. 11 is a view showing the cap direction changing section rotated counterclockwise from a standby position in FIG. 10.
Figure 12:
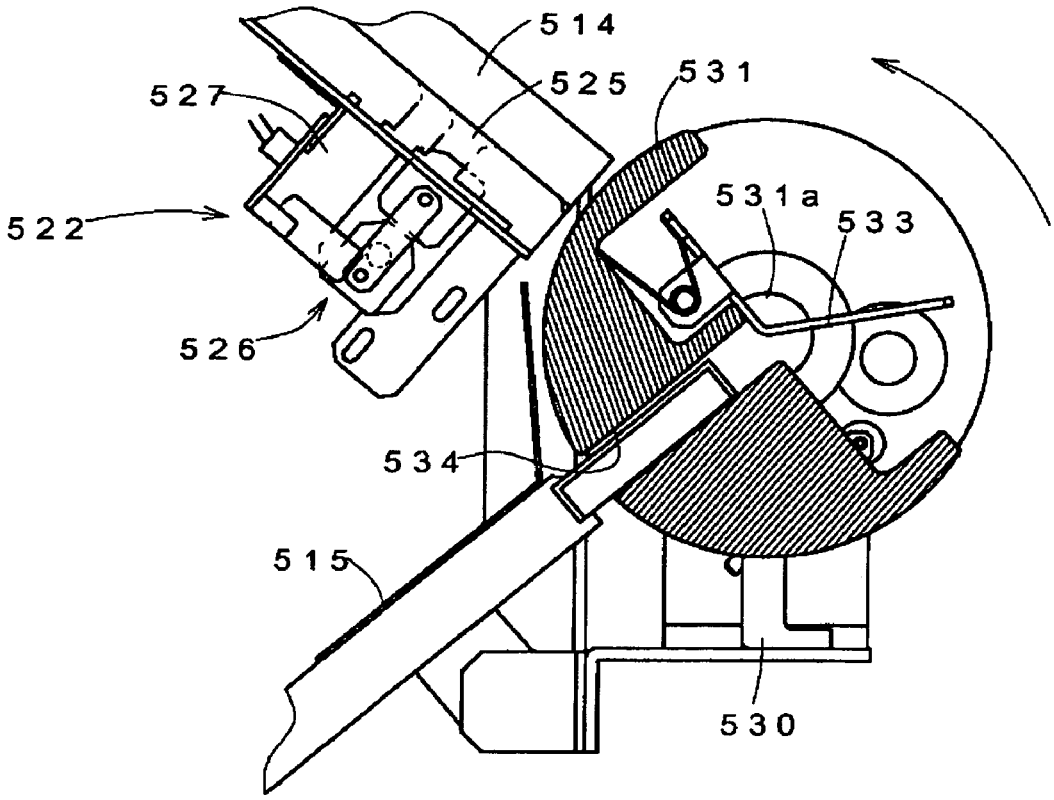
FIG. 12 is a view showing the cap direction changing section rotated clockwise from the standby position in FIG. 10.

Moreover, the cap direction changing section 513 is positioned at a standby position shown in FIG. 10 in an initial state where the guide pathway 534 connects to the first cap pathway 514. When the motor 512 is driven in the forward direction to rotate the cylindrical body 531 around the spindle 531*a* counterclockwise (shown by an arrow in FIG. 12), the connected destination of the guide pathway 534 can be changed from the first cap pathway 514 to the second cap pathway 515 as shown in FIG. 12. In the case where the inner recess section 2*a* of the cap 2 is positioned downward, the changeover is used for moving the cap 2 from the first cap pathway 514 to the second cap pathway 515 while maintaining the state. When the motor 512 is rotated in the backward direction to rotate the cylindrical body 531 around the spindle 531*a* clockwise (shown by an arrow in FIG. 11), the inclination of the guide pathway 534 conforms to that of the second cap pathway 515 as shown in FIG. 11. Moreover, a contact section 530*c* comes into contact with one end section of the guide plate 533, by which the other end side of the guide plate 533 connects the guide pathway 534 and the second cap pathway 515. Consequently, the cap 2 in the guide pathway 534 can move to the second cap pathway 515. In the case where the inner recess section 2*a* of the cap 2 moving through the first cap pathway 514 is positioned upward, the changeover is used for changing the direction so as to position the inner recess section 2*a* downward and then moving the cap 2 to the second cap pathway 515.

Figure 13:
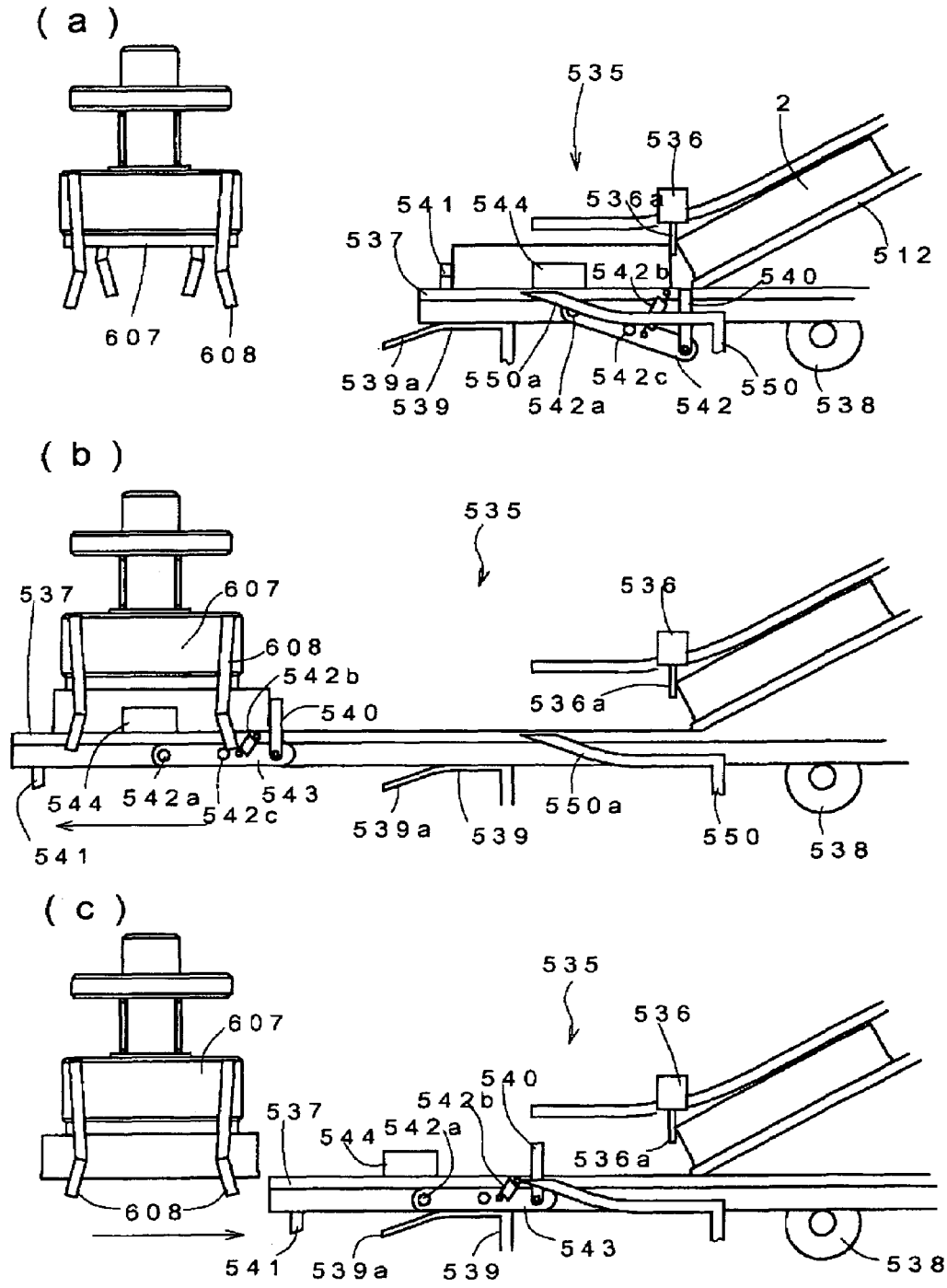
FIG. 13(*a*) is a view showing a cap fed to a feeding tray, FIG. 13(*b*) is a view showing the feeding tray forwarded from the state shown in FIG. 13(*a*), and FIG. 13(*c*) is a view showing the feeding tray retreated from the state shown in FIG. 13(*b*)

As shown in FIG. 13, the second cap pathway 515 has a cap standby section 535 on its lower end portion. The cap standby section 535 includes an actuator 536 for temporarily stopping the cap 2 and a feeding tray 537 which can reciprocate in the horizontal direction. The actuator 536 energizes and demagnetizes a solenoid for protruding and withdrawing a rod 536*a* in the second cap pathway 515 so as to approve and reject the feeding of the cap 2 to the feeding tray 537.

The outer circumferential section of the tray 537 has four notches evenly provided for avoiding the interference with an engagement piece 608 when the mounted cap 2 is retained by a later-described cap retaining section 604. Moreover, the feeding tray 537, which is mounted on a roller 538 and a mounting tray 539, reciprocates in the horizontal direction by rotational driving of the roller 538. The top end of the mounting tray 539 has an inclined section 539*a* gradually extending upward. Moreover, the feeding tray 537 includes a first rod 540 and a second rod 541 protruding from and withdrawing to the upper surface. The first rod 540 is provided on the other end section of a link 542 which rotates around a spindle 542*a* placed on one end portion. The link 542 is biased to be in the horizontal state by a spring 542*b*. In this state, the first rod 540 protrudes upward from the feeding tray 537. The second rod 541 protrudes upward from the feeding tray 537 upon being pressed by the mounting tray 539 and withdraws into the feeding tray 537 upon distancing from the mounting tray 539.

In the case where the feeding tray 537 is at a standby position continuing to the second cap pathway 515, a protrusion 542*c* formed in the middle section of the link 542 comes into contact with an inclined section 550*a* of a guide piece 550, by which the link 542 rotates against the biasing force of the spring 542*b* so that the second rod 541 retreats from the upper surface of the feeding tray 537. Therefore, driving the actuator 536 to retreat the rod 536*a* makes it possible to feed the cap 2 from the second cap pathway 515 to the feeding tray 537. Once the feeding tray 537 is advanced in the state where the cap 2 has been fed to the feeding tray 537, the protrusion 542*c* of the link 542 moves along the inclined section 539*a* of the mounting tray 539, so that the first rod 540 gradually protrudes upward from the feeding tray 537. Consequently, the cap 2 is pressed by the first rod 540 and advances together with the feeding tray 537. The cap 2 mounted on the advanced feeding tray 537 is transferred by the later-described cap retaining section 604, and the upper opening of the vial bottle 3 is closed.

It is to be noted that whether or not the cap 2 is fed onto the feeding tray 537 is detected by a second cap sensor 543.

3. Operation of Cap Feeding Section 500

The operation of the cap feeding section 500 will now be described.

(Cap Feeding Control)

Figure 18:
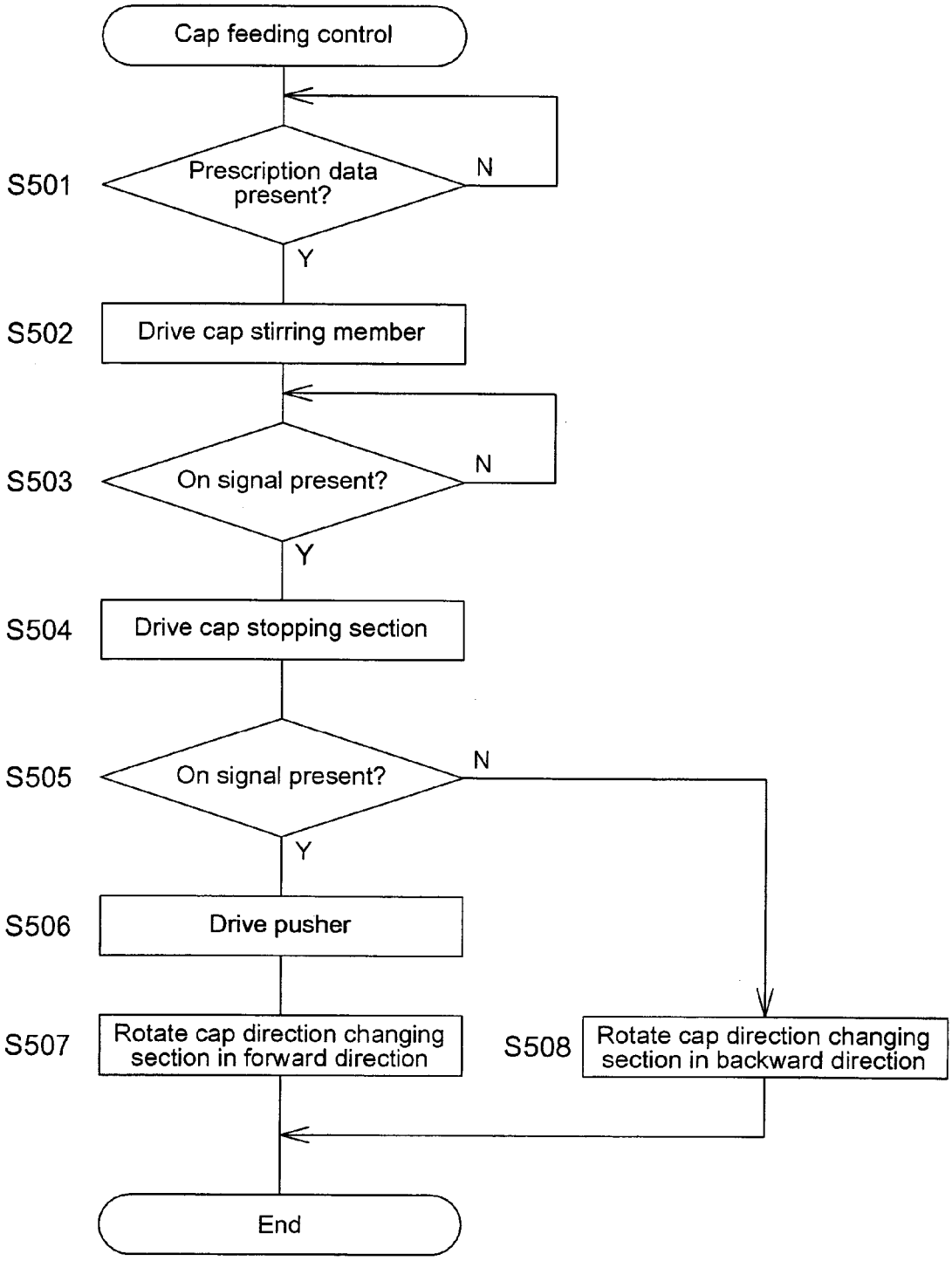
FIG. 18 is a flowchart showing cap feeding control.

As shown in FIG. 18, once the kind and amount of medicine contained in the vial bottle 3 are determined based on the inputted prescription data (step S501), a vial bottle 3 of an appropriate size is selected based on the kind and the amount. Thus, driving of the cap feeding section 500 is started.

First, the cap stirring member 502 is driven to stir the caps 2 in the cap container 501 (step S502). The cap stirring member 502 is provided in two locations, and their stirring sections 510, each made of a wire rod, are moved from the lower side to the upper side by the first inclined surface 504 and the second inclined surface 505 constituting the bottom surface of the cap container 501. Moreover, the stirring sections 510 are placed in a spiral way for stirring the caps 2 so that the caps 2 are moved to the inclined section 516. Accordingly, after the caps 2 are temporarily moved away from the vicinity of the gap section 519, the caps 2 are stirred by the stirring sections 510 so that they advance toward the gap section 519. Therefore, although only one cap 2 can pass through the clearance of the gap section 519, the caps 2 can smoothly go into the first cap pathway 514.

The caps 2, which have gone into the first cap pathway 514, are aligned by passing the alignment pathway 520 and stopping at the cap stopping section 521. At this point, whether or not the cap 2 is detected is determined by a sensor (not shown) provided in the cap stopping section 521 (step S503). If the cap 2 is detected, then the cap stopping section 521 is rotated (step S504) so that only one cap 2 is retained by the stop recess section 523, and the cap 2 is moved to the further downstream side.

The caps 2 aligned in the first cap pathway 514 include both the caps with the inner recess section 2*a* positioned downward and the caps with the inner recess section 2*a* positioned upward. The caps with the inner recess section 2*a* positioned downward stop at the removed section 525 in an inclined state gained by the upper notch ends of the chute rails 524 engaging with the inner recess section 2*a*. Therefore, a detection signal in the first cap sensor 527 is switched to an on state. The caps with the inner recess section 2*a* positioned upward slide on the chute rails 524 in the first cap pathway 514 and directly into the guide pathway 534 in the cap direction changing section 513 without stopping at the removed section 525. Therefore, the detection signal in the first cap sensor 527 maintains an off state.

At this point, it is determined whether or not an on signal is outputted from the first cap sensor 527 (step S505). If the on signal is outputted, the pusher 526 is driven in response to the on signal (step S506). As a result, the cap 2 is released from the stopped state in the removed section 525 and restarts movement in the first cap pathway 514 so as to go into the guide pathway 534 in the cap direction changing section 513 as shown in FIG. 10. In the cap direction changing section 513, the motor 512 is driven in the forward direction in response to the on signal by the first cap sensor 527 (step S507) to rotate around the spindle 531*a* counterclockwise, so that the guide pathway 534 is positioned on the same straight line with the second cap pathway 515 as shown in FIG. 12. This makes the cap 2 in the guide pathway 534 move to the second cap pathway 515 while maintaining the state of the inner recess section 2*a* positioned downward.

The caps 2 with the inner recess section 2*a* positioned upward directly go, as shown in FIG. 10, into the guide pathway 534 in the cap direction changing section 513, where the motor 512 is driven in the backward direction in response to the off signal by the first cap sensor 527 (step S508) so as to rotate the cylindrical body 531 around the spindle 531*a* clockwise (shown by an arrow in FIG. 11). This rotation positions the guide pathway 534 on the same straight line with the second cap pathway 515 via the guide plate 533 and changes the direction of the cap 2 so as to position the inner recess section 2*a* downward. Moreover, in the guide plate 533, during rotation of the cap direction changing section 513, a curved section of the guide plate 533 closes the guide pathway 534 by the biasing force of the spring 532*b*. With the one end section of the guide plate 533 being pressed by the contact section 530*c*, the spring 532*b* is elastically deformed so that the other end side is positioned on the same straight line connecting the guide pathway 534 and the second cap pathway 515. Therefore, the cap 2 in the guide pathway 534 moves to the second cap pathway 515 only after the cap direction changing section 513 rotates to a dispensing position shown in FIG. 11.

The cap 2 moving to the second cap pathway 515 slides and is temporarily stopped at a standby position by the rod 536*a* as shown in FIG. 13(*a*). When the cap 2 has its turn, the rod 536*a* is retreated from the second cap pathway 515 so that the cap 2 is moved to the feeding tray 537. In this case, since the feeding tray 537 is positioned on the mounting tray 539 with the second rod 541 protruding on the top end side, the cap 2 keeps on moving till it comes into contact with the second rod 541. Once the cap 2 comes into contact with the second rod 541 and is positioned (once a predetermined time elapsed after the retreat of the rod 536*a*), the feeding tray 537 is advanced. With the advance of the feeding tray 537, the protrusion 542*c* moves along the inclined section 550*a* due to the biasing force of the spring 542*b*, by which the link 542 rotates around the spindle 542*a* counterclockwise. Consequently, the first rod 540 protrudes from the upper surface of the feeding tray 537 and so the cap 2 advances together with the feeding tray 537.

4. Structure of Capping Section 600

The capping section 600 includes a retaining member 601 and a container lifting member (container lifter) 602.

Figure 14:
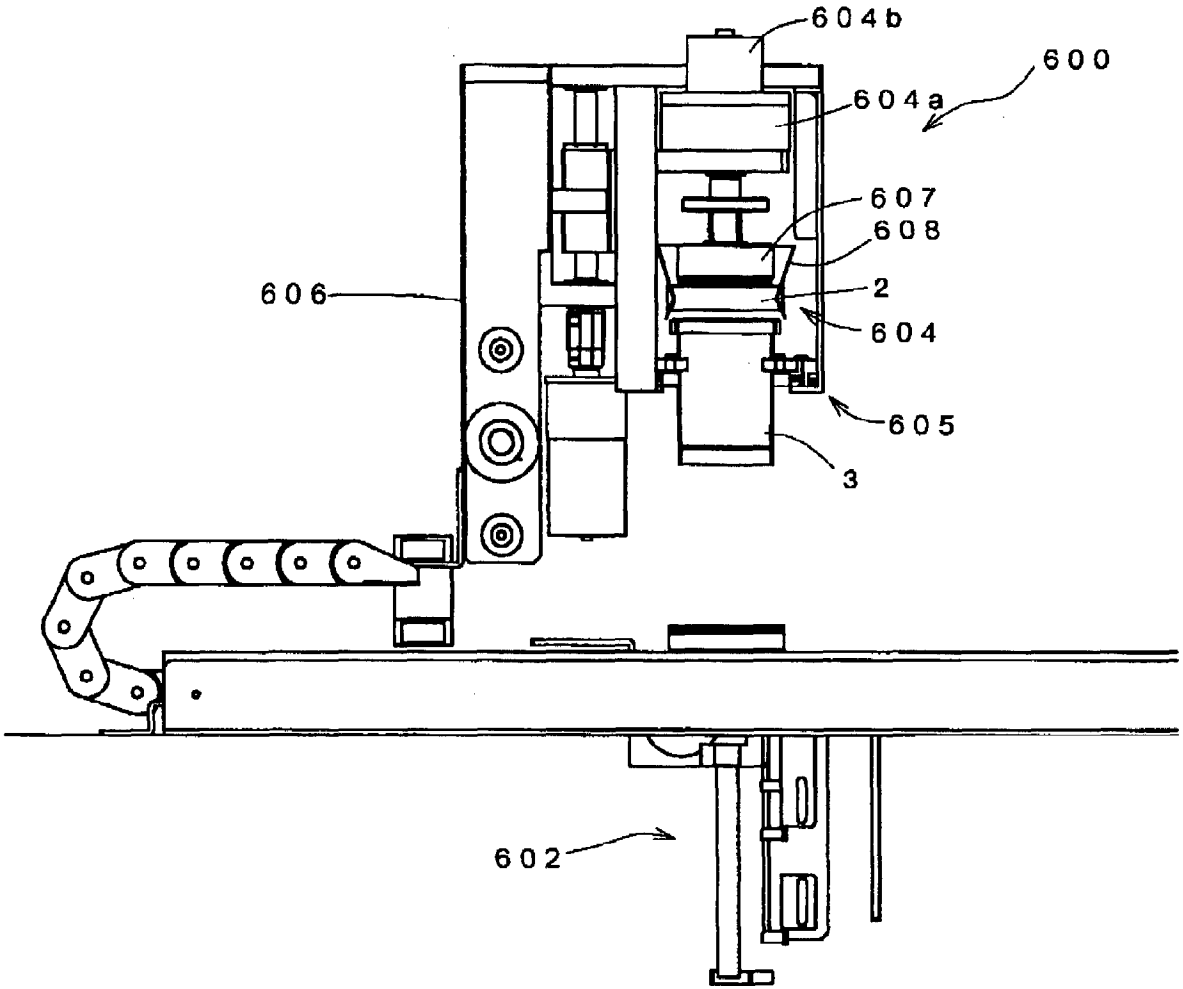
FIG. 14 is a front view showing a capping section.
Figure 15:
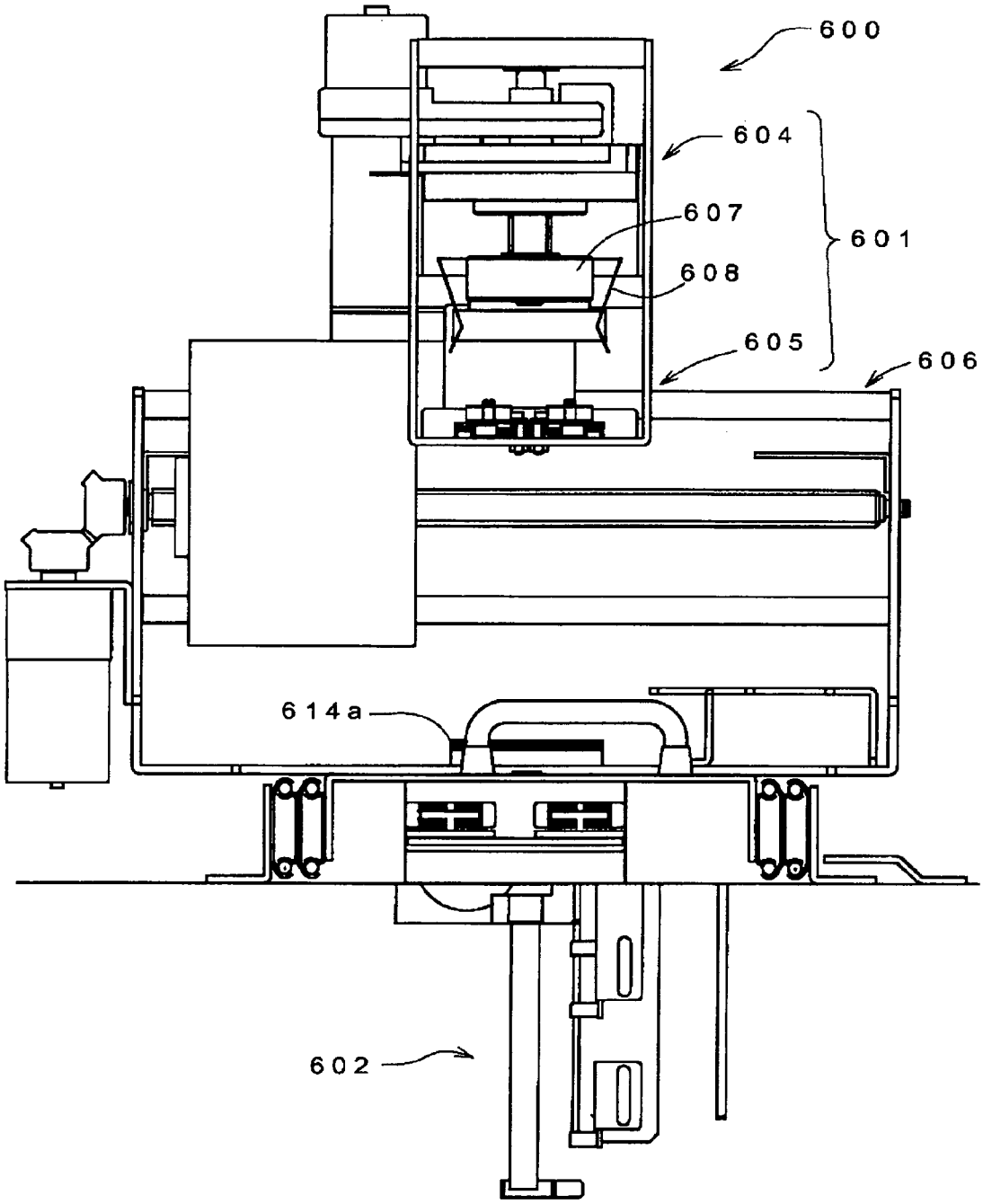
FIG. 15 is a side view showing the capping section.

As shown in FIG. 14 and FIG. 15, the retaining member 601, which is composed of a cap retaining section (cap retaining device) 604 and a container retaining section (container retaining device) 605, is provided on a sliding member (sliding device) 606 movable in the horizontal direction (two orthogonal directions).

Figure 16:
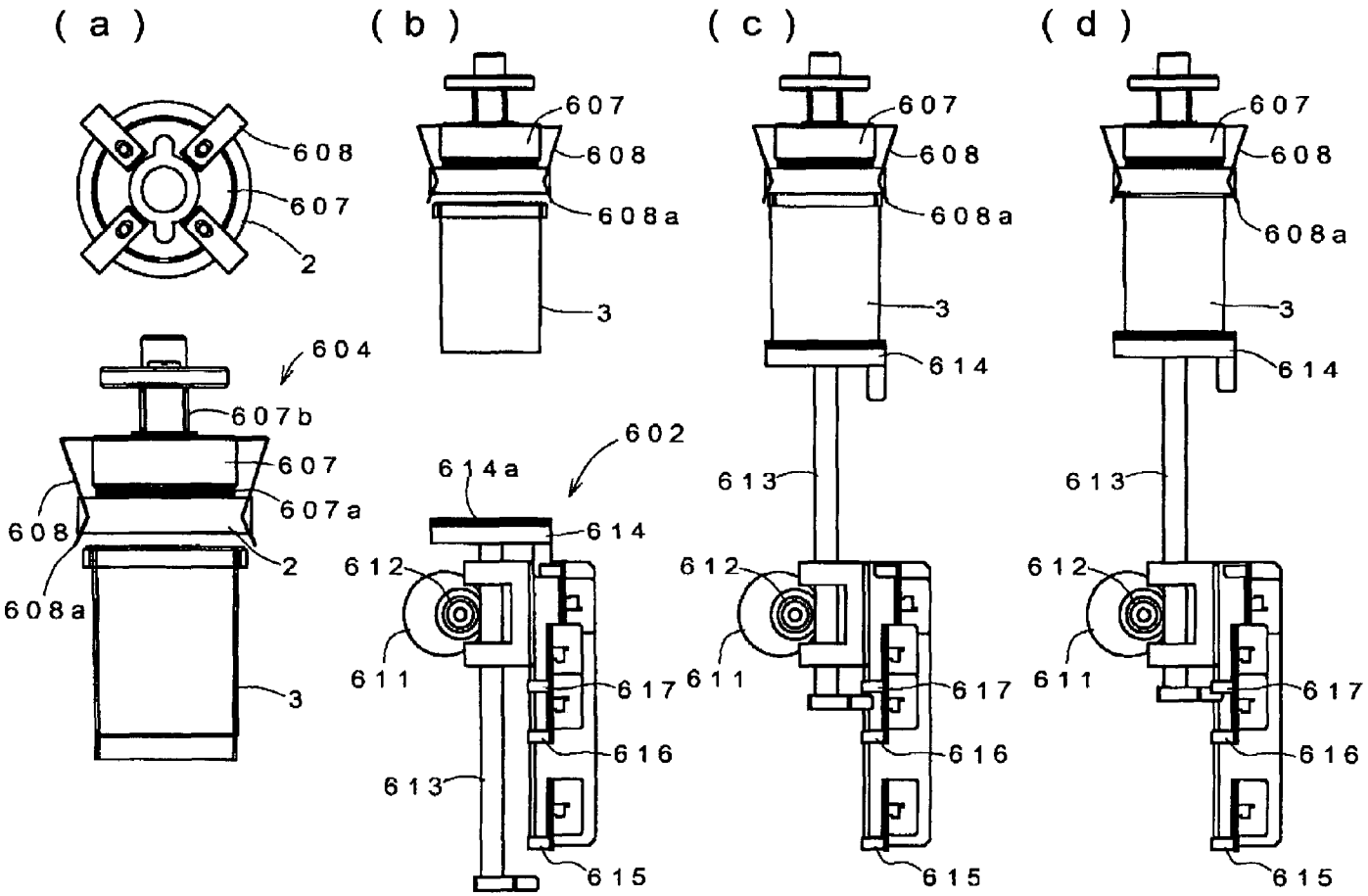
FIG. 16(*a*) is a plan view and a front view showing the capping section, FIG. 16(*b*) is a front view showing a vial bottle before being lifted up, FIG. 16(*c*) is a front view showing the vial bottle immediately after the start of lifting up, and FIG. 16(*d*) is a front view showing the vial bottle after a cap is mounted.

As shown in FIG. 14, the cap retaining section 604 includes a pressing section 607 which ascends and descends by driving of an actuator 604*a* and which rotates by driving of a motor 604*b*, and four engagement pieces 608 for retaining the outer circumferential surface of the cap 2. The pressing section 607 has, as shown in FIG. 16(*a*), an anti-slip section 607*a* made of a material having a large coefficient of friction for preventing the slipping of the cap 2 during pressing and rotation of the cap 2. Moreover, the pressing section 607 has a spring 607*b* for allowing elastic pressing of the cap 2. The engagement pieces 608, which are made of plate springs and the like, are equally placed at four locations around the pressing section 607. The engagement pieces 608 are gradually inclined inward toward their top ends. Moreover, the top end sections of the engagement pieces 608 are curved so as to be widened toward the external diameter, so that the curved sections 608*a* can elastically retain the outer circumferential surface of the cap 2.

Figure 17:
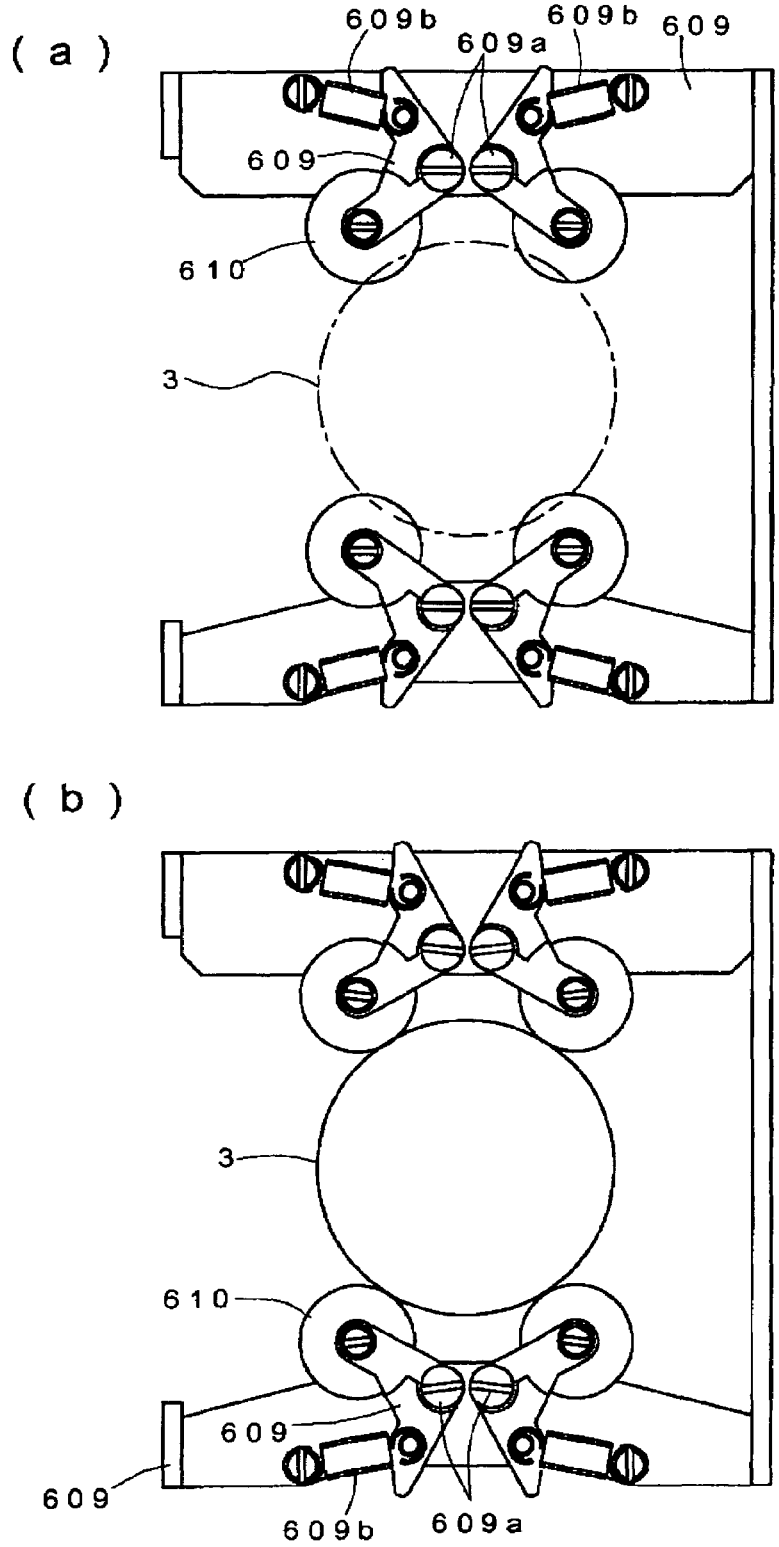
FIG. 17(*a*) is a plan view showing a container retaining section before retaining a vial bottle, and FIG. 17(*b*) is a plan view showing the container retaining section after retaining the vial bottle.

As shown in FIG. 17, the container retaining section 605 is composed of container retaining arms 609 placed at specified intervals, the container retaining arms 609 each have a pair of container retaining rollers 610, so that these four container retaining rollers 610 support the vial bottle 3. The container retaining arm 609 is provided rotatably around a spindle 609*a* provided on its curved section, and the container retaining roller 610 is rotatably mounted on its one end section while a spring 609*b* is engaged with the other end section thereof. By the biasing force of the spring 609*b*, each pair of the container retaining rollers 610 is biased so as to be closer to each other.

The container lifting member 602 is for lifting a lifting tray 614 via a pinion 614 and a rack 613 by driving of a lifting motor 611. As with the pressing section 607, an anti-slip section 614*a* made of a material having a large coefficient of friction is provided on the upper surface of the lifting tray 614. Moreover, the lifting position of the lifting tray 614 is detected by each of a first sensor 615, a second sensor 616 and a third sensor 617.

It is to be noted that the vial bottle 3 with medicine fed thereto at the transfer position is transferred by the third transfer robot 350 to the capping section 600. The third transfer robot 350, which has a pair of nip pieces, which can open and close, is slidable in the horizontal direction.

5. Operation of Capping Section 600

The operation of the capping section 600 will be described below.

(Vial Bottle Feeding Control)

Figure 19:
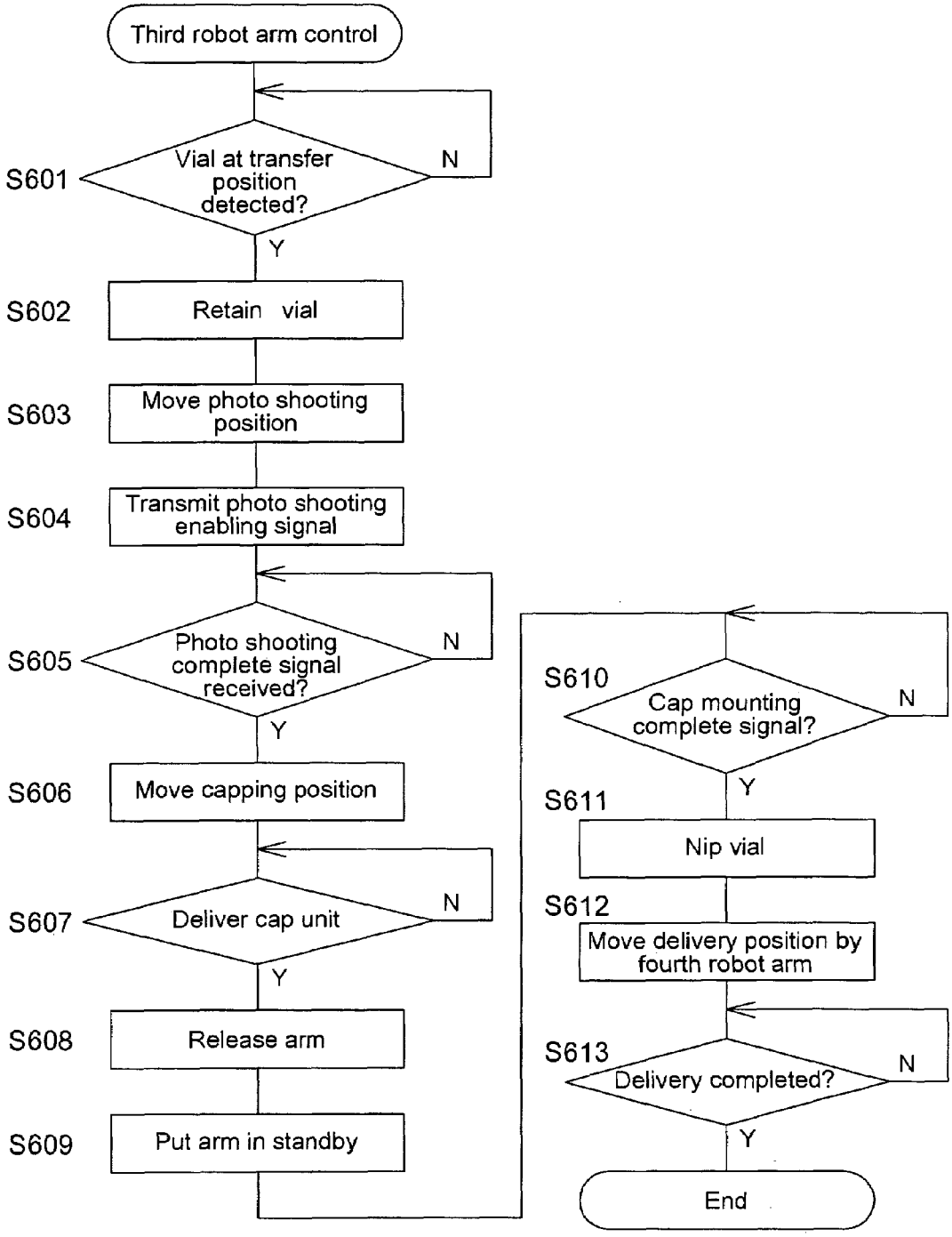
FIG. 19 is a flowchart showing vial bottle feeding control.

As shown in FIG. 19, once a vial bottle 3 with medicine fed thereto at the transfer position is detected (step S601), the third transfer robot 350 is driven to retain the vial bottle 3 (step S602). Then, the vial bottle 3 is moved to a photo shooting position for photo shooting of the medicine in the vial bottle 3 by a medicine image pickup member (not shown) (step S603), while a photo shooting enabling signal is transmitted (step S604). At this point, the capping section 600 is moved over the cap standby section 535 and the pressing section 607 and the engagement pieces 608 are lowered so that the cap 2 on the feeding tray 537 is retained by the engagement pieces 608. It is also possible to lower the engagement pieces 608 to the level of the feeding tray 537 in advance before the cap 2 is fed onto the feeding tray 537 so that the cap 2 is retained by the engagement pieces 608 from the lateral side.

Upon completion of the photo shooting and reception of an outputted photo shooting complete signal (step S605), the vial bottle 3 is moved to a capping position where the cap 2 can be mounted on the vial bottle 3 by the cap retaining section 604 and the container lifting member 602 (step S606). At the capping position, the vial bottle 3 is retained by the container retaining section 605 (step S607), while the vial bottle 3 retained by the third transfer robot 350 is released (step S608). The third transfer robot 350 is put in standby on the spot (step S609).

Upon mounting of the cap 2 on the vial bottle 3 and reception of a cap mounting complete signal under later-described capping control (step S610), the vial bottle 3 is retained again by the third transfer robot 350 (step S611), and is moved to a later-described delivery position (step S612). At the delivery position, the vial bottle 3 is delivered to the fourth robot arm, by which the operation of the third transfer robot 350 (vial bottle feeding control) is finished (step S613).

(Capping Control)

Figure 20:
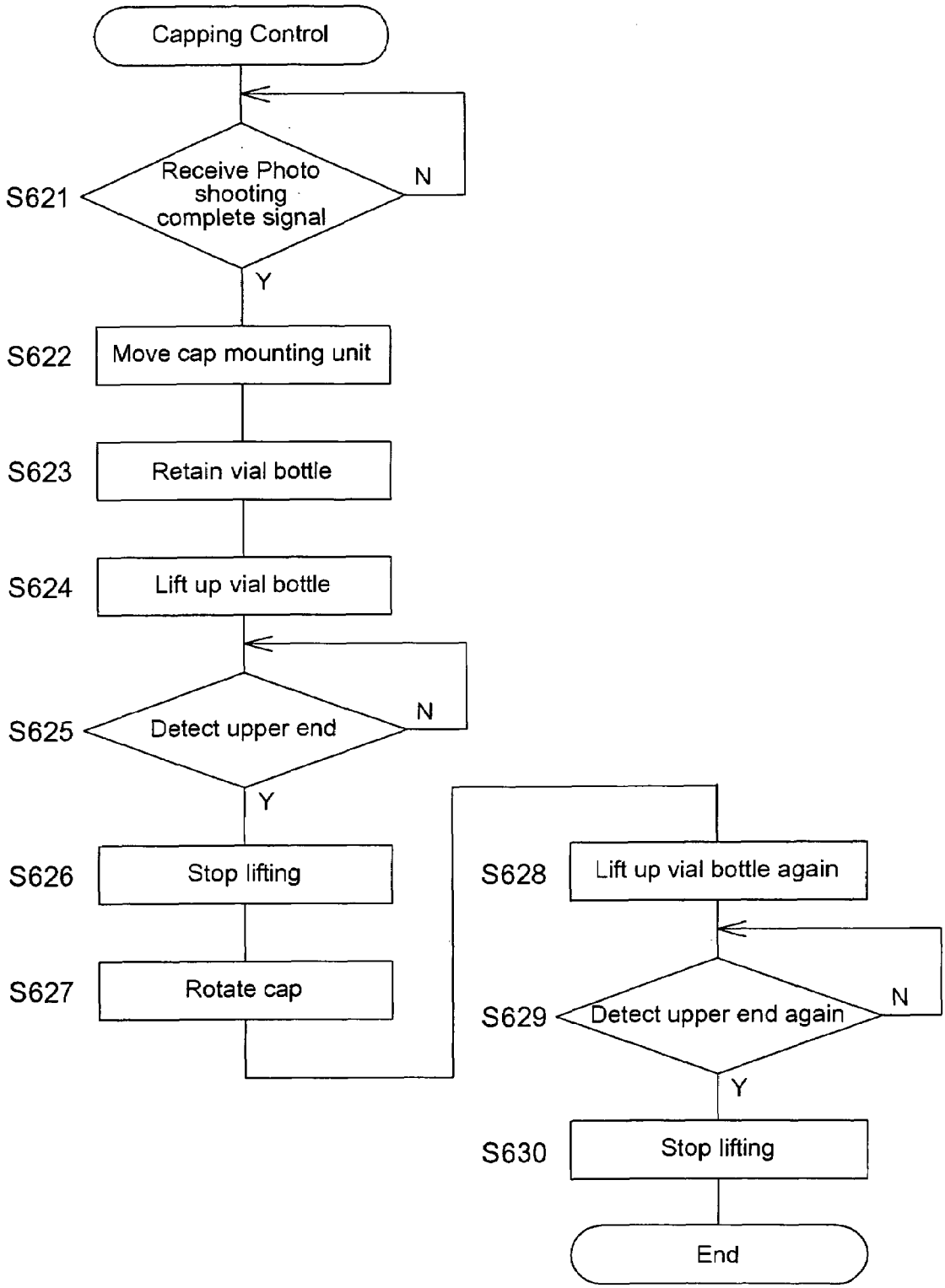
FIG. 20 is a flowchart showing cap closing control.

As shown in FIG. 20, upon reception of the photo shooting complete signal (step S621), the retaining member 601 is driven so that the cap retaining section 604 retains the cap 2 which is ready on the feeding tray 537 of the cap feeding section 500 under the cap feeding control (see FIG. 18) (step S622). More specifically, the cap retaining section 604 is moved over the feeding tray 537, and the actuator 536 is driven to lower the engagement pieces 608. Since the engagement pieces 608 have elasticity, the curved section thereof is widened upon coming into contact with the upper edge section of the cap 2 and thereby comes into tight contact with the outer circumferential surface of the cap 2, by which the cap 2 is retained. In this case, since the feeding tray 537 is formed into a generally crucial shape, it would not interfere with the engagement pieces 608.

Once the cap 2 is retained, the retaining member 601 is driven again so that the vial bottle 3 transferred into the capping section 600 is retained by the container retaining section 605 (step S623) as shown in FIG. 16(*b*). Then, the motor 512 is driven to raise the lifting tray 614 to lift the vial bottle 3 retained by the container retaining section 605 (step S624). In response to a detection signal by the sensor (step S625), the lifting tray 614 is temporarily stopped at the position where the upper opening of the vial bottle 3 comes into contact with the cap 2 as shown in FIG. 16(*c*). Then, the motor 512 is driven to rotate the cap 2 (step S627) and the lifting tray 614 is again raised as shown in FIG. 16(*d*) (step S628). After that, in response to a detection signal by the sensor (step S629), the lifting tray 614 is stopped (step S630). Consequently, the engagement section of the vial bottle 3 can be engaged with the engagement receiving section of the cap 2 while the cap 2 is pressed to the upper opening of the vial bottle 3 against the biasing force of the elastic protruding section of the cap 2, resulting in implementation of smooth mounting of the cap 2.

(Second Capping Control)

Figure 21:
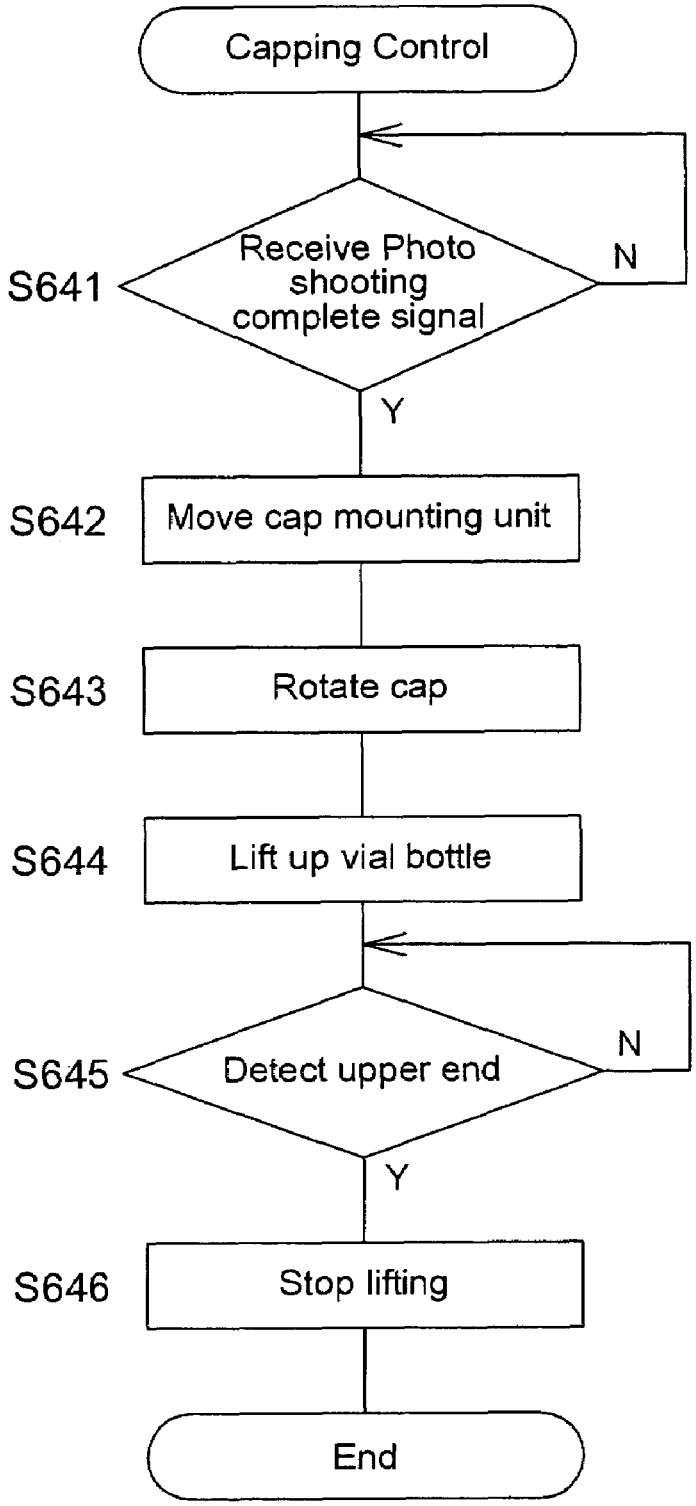
FIG. 21 is a flowchart showing another cap closing control.

It is to be noted that the mounting process of the cap 2 may be as follows. That is, as shown in FIG. 21, upon reception of the photo shooting complete signal (step S641), the vial bottle 3 is retained (step S642), and then the cap 2 is first rotated (step S643). Then, the vial bottle 3 is lifted (step S644) till it reaches a specified position (step S645), by which the lifting operation is finished (step S646). According to the process, the cap 2 has only to be rotated at the moment when the preparation for lifting the vial bottle 3 is completed, which makes it possible to facilitate control procedures.

(Third Capping Control)

Figure 22:
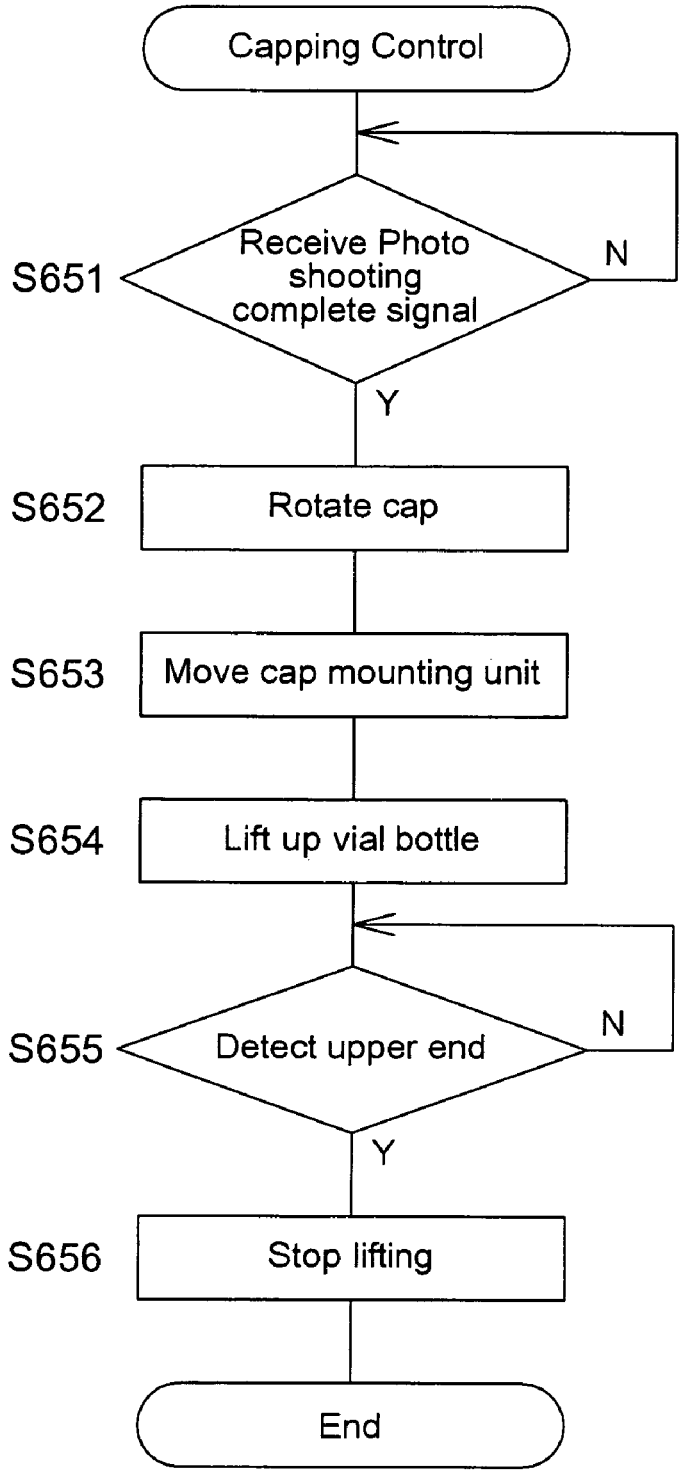
FIG. 22 is a flowchart showing another cap closing control.

Moreover, as shown in FIG. 22, upon reception of a photo shooting complete signal (step S651), the cap 2 is rotated (step S652). Then, after the vial bottle 3 is retained (step S653), the vial bottle 3 is lifted (step S654) till it reaches a specified position (step S655), by which the lifting operation is finished (step S656). According to the process, the cap 2 has only to be rotated from the beginning of the mounting operation, which makes it possible to further facilitate the control procedures.

(Fourth Capping Control)

Figure 23:
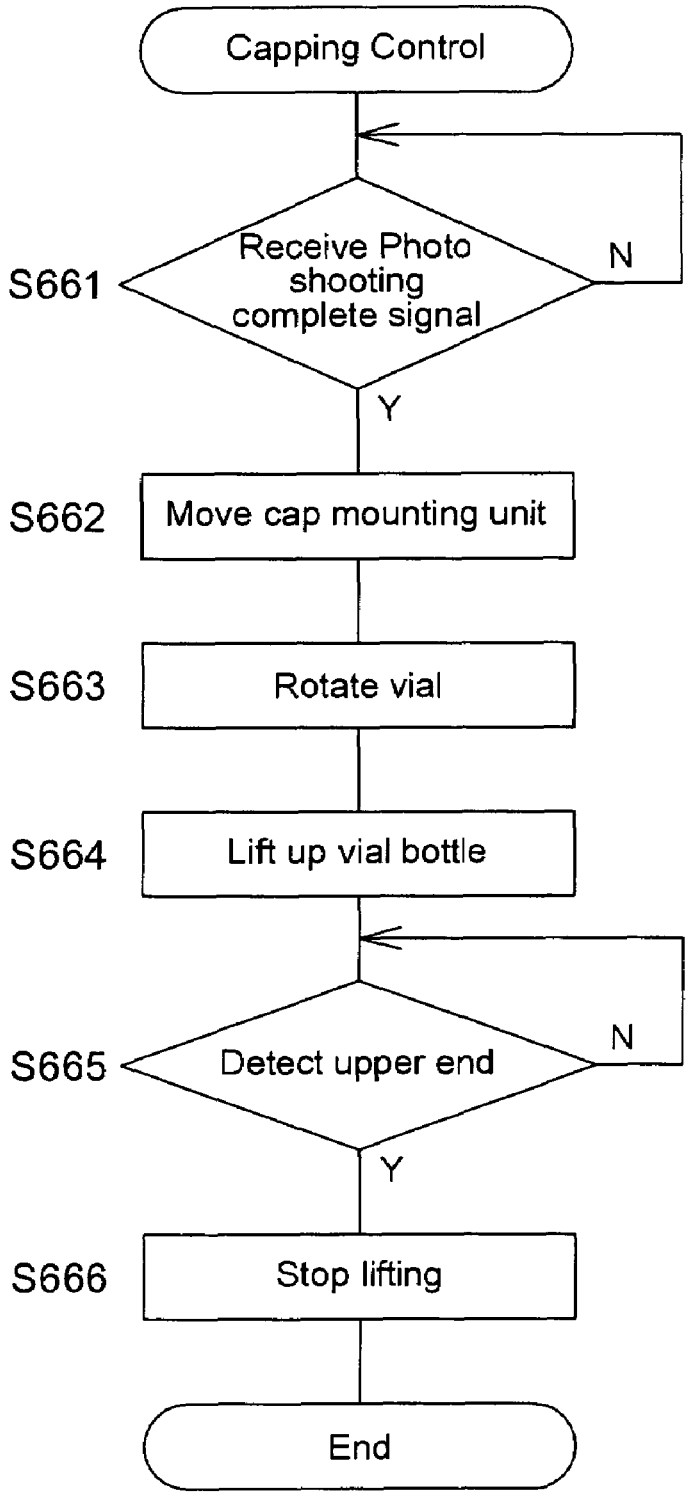
FIG. 23 is a flowchart showing another cap closing control.

Moreover, as shown in FIG. 23, upon reception of a photo shooting complete signal (step S661), the vial bottle 3 is retained (step S662) and then the vial bottle 3 is rotated (step S663). Then, the vial bottle 3 is lifted (step S664) till it reaches a specified position (step S665), by which the lifting operation is completed. In this control, however, a mechanism for rotating the vial bottle 3 is necessary in place of the mechanism for rotating the cap 2.

(Vial Bottle Discharge Control)

Thus, the vial bottle 3 with the cap 2 mounted thereon is transferred to a specified position by the fourth transfer robot 450. The fourth transfer robot 450, which is rotatably provided, has an openable nip plate (not shown) on its top end.

Figure 24:
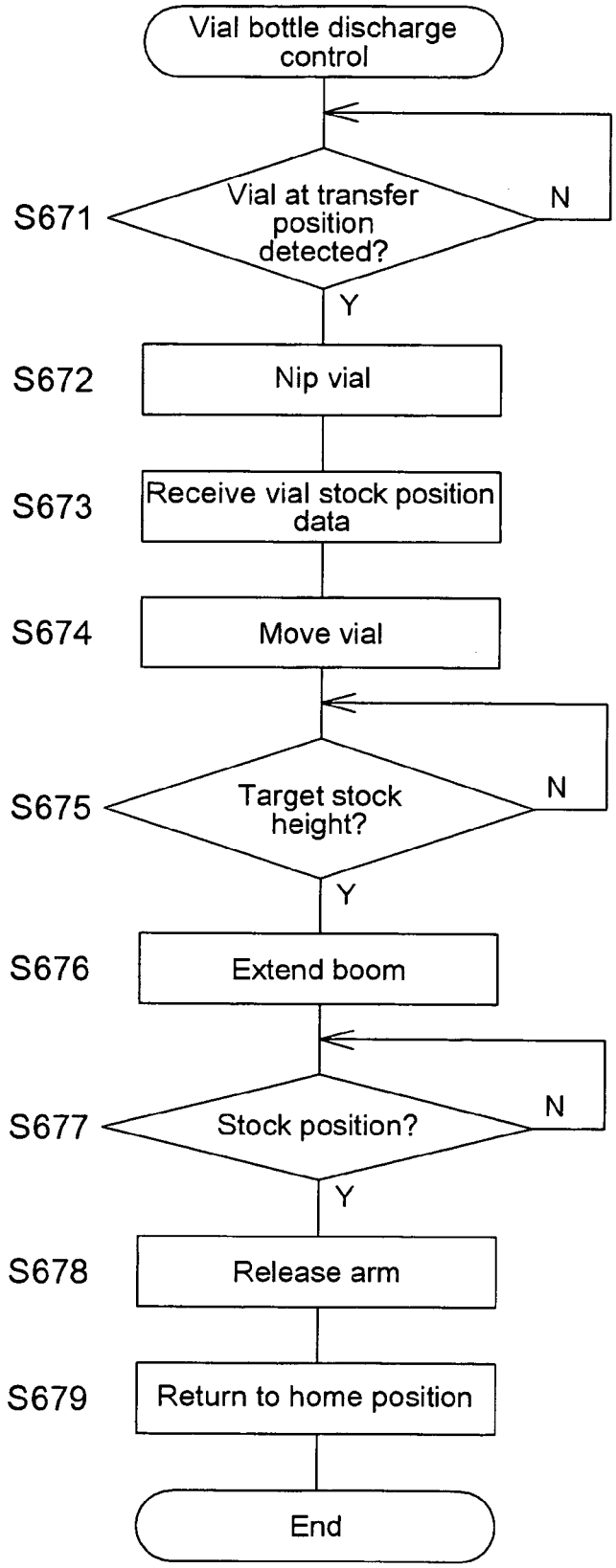
FIG. 24 is a flowchart showing vial bottle delivery control.

In the vial bottle discharge control as shown in FIG. 24, once the vial bottle 3 is detected at the transfer position (step S671), the vial bottle 3 is retained by the third transfer robot 350 (step S672), and stock location data on the vial bottle 3 is received (step S673). Then, the third transfer robot 350 is driven to move the vial bottle 3 (step S674), and the third transfer robot 350 is raised or lowered based on the stock location data. Once the vial bottle 3 reaches a target stock height (step S675), an arm is extended (step S676), and when the vial bottle 3 reaches the stock position (step S677), the arm is released to deliver the vial bottle 3 to the fourth transfer robot 450 (step S678). After that, the third transfer robot 350 is moved (returned) to a home position, i.e., the transfer position (step S679).

The invention claimed is:

1. A medicine storing and dispensing apparatus including a cap feeding section, the cap feeding section comprising:

a cap container for storing a plurality of caps for closing openings of medicine containers, the cap container having a slit formed at least in one location of a bottom surface of the cap container;

a first cap stirring member having a rotating shaft and at least one stirring section protruding from the rotating shaft, wherein the stirring section protrudes inside the cap container through the slit in the bottom surface of the cap container, wherein the stirring section stirs the caps upon rotational driving of the rotating shaft; and a cap path which continues to the cap container, and has a clearance that allows only one cap at a time to pass through, the cap path being inclined downward so as to align the passing caps.

2. The medicine storing and dispensing apparatus according to claim 1, wherein the cap container has an inclined surface inclined toward the rotating shaft of the cap stirring member, the inclined surface having the slit formed therein.

3. The medicine storing and dispensing apparatus according to claim 2, wherein the cap stirring member is structured so that the stirring section has a plurality of protruding sections placed on an outer circumferential section of the rotating shaft for allowing stirring of the caps toward an upper side of the inclined surface through rotational driving of the rotating shaft.

4. The medicine storing and dispensing apparatus according to claim 1, wherein the cap stirring member is structured so that the stirring section has a plurality of protruding sections placed in a spiral manner on an outer circumferential section of the rotating shaft for allowing movement of the caps from one end side to the other end side of the rotating shaft through rotational driving, and wherein the cap pathway is placed on the other end side of the rotating shaft.

5. The medicine storing and dispensing apparatus according to claim 1, further comprising a second cap stirring member, wherein the first and second cap stirring members are positioned so as to be parallel to each other.

6. The medicine storing and dispensing apparatus according to claim 1, wherein the cap pathway includes:

an inclined support section for supporting incoming caps by engaging with inner recess sections of the moving caps so as to further incline the inner recess sections in a case where the passing caps are positioned with the inner recess sections being oriented downward;

a cap detecting section for detecting the caps supported in an inclined state by the inclined support section;

extruding means for moving the caps by canceling an engaged state of the caps supported by the inclined support section based on a detection result by the cap detecting section; and a cap direction changing section for changing a direction of the caps based on the detection result by the cap detecting section so as to orient the inner recess sections in an identical direction.

7. The medicine storing and dispensing apparatus according to claim 6, wherein the cap pathway has a pair of chute rails placed at an interval smaller than an inner diameter of the inner recess sections of the caps, and wherein the inclined support section is formed by cutting away a part of the chute rails.

8. The medicine storing and dispensing apparatus according to claim 1, wherein the cap pathway is composed of a first cap pathway positioned on an upstream side of the cap direction changing section, a second cap pathway positioned on a downstream side of the cap direction changing section and placed orthogonal to the first cap pathway, and a cap direction changing section positioned between the first and second cap pathway, wherein the cap direction changing section includes a rotatable body defining a guide pathway for receiving the caps, which have moved through the first cap pathway, in an inclined state through a first opening on one end side of the guide pathway, and a guide plate for preventing the caps from dropping from a second opening on the other end side of the guide pathway, and wherein when the rotatable body of the cap direction changing section is rotated so as to orient the second opening of the guide pathway obliquely downward, the guide plate is operated to connect the second opening and the second cap pathway to permit movement of the caps.

9. The medicine storing and dispensing apparatus according to claim 3, wherein each of the stirring sections comprises a wire rod.

10. The medicine storing and dispensing apparatus according to claim 4, wherein each of the stirring sections comprises a wire rod.

* * * * *